US009453377B2

(12) United States Patent
Mosing et al.

(10) Patent No.: US 9,453,377 B2
(45) Date of Patent: Sep. 27, 2016

(54) ELECTRIC TONG SYSTEM AND METHODS OF USE

(71) Applicant: Frank's International, LLC, Houston, TX (US)

(72) Inventors: Donald E. Mosing, Lafayette, LA (US); Vernon J. Bouligny, Lafayette, LA (US)

(73) Assignee: Frank's International, LLC, Houston, TX (US)

( * ) Notice: Subject to any disclaimer, the term of this patent is extended or adjusted under 35 U.S.C. 154(b) by 0 days.

(21) Appl. No.: 14/520,083

(22) Filed: Oct. 21, 2014

(65) Prior Publication Data

US 2015/0107850 A1 Apr. 23, 2015

Related U.S. Application Data

(60) Provisional application No. 61/893,819, filed on Oct. 21, 2013, provisional application No. 62/001,500, filed on May 21, 2014.

(51) Int. Cl.
*E21B 19/16* (2006.01)

(52) U.S. Cl.
CPC ..... *E21B 19/164* (2013.01); *E21B 19/165* (2013.01)

(58) Field of Classification Search
USPC ..... 166/377; 81/57.16, 185.2, 57.34, 57.35, 81/57.33, 57.24, 57.19, 57.21, 57.36, 81/57.44
See application file for complete search history.

(56) References Cited

U.S. PATENT DOCUMENTS

| | | | | |
|---|---|---|---|---|
| 2,351,887 | A | 6/1944 | Steadman | |
| 2,383,275 | A | 8/1945 | Scane | |
| 4,060,014 | A | 11/1977 | Turner | |
| 4,082,017 | A | 4/1978 | Eckel | |
| 4,163,401 | A | 8/1979 | Sheldon et al. | |
| 4,202,225 | A | 5/1980 | Sheldon et al. | |
| 4,306,339 | A | 12/1981 | Ward | |
| 4,334,444 | A * | 6/1982 | Carstensen | E21B 19/164 81/57.18 |
| 4,579,379 | A | 4/1986 | Berg | |
| 4,591,007 | A | 5/1986 | Shaginian et al. | |
| 4,989,909 | A | 2/1991 | Bouligny, Jr. et al. | |
| 5,099,725 | A | 3/1992 | Bouligny, Jr. et al. | |
| 5,245,265 | A | 9/1993 | Clay | |
| 5,388,651 | A | 2/1995 | Berry | |
| 5,390,568 | A | 2/1995 | Pietras et al. | |
| 5,791,410 | A | 8/1998 | Castille et al. | |
| 6,142,040 | A | 11/2000 | Bouligny | |
| 6,386,283 | B1 | 5/2002 | Mosing et al. | |
| 6,668,684 | B2 | 12/2003 | Allen et al. | |

(Continued)

*Primary Examiner* — Taras P Bemko

(57) ABSTRACT

An automated, electric tong system and methods usable for making-up and breaking out threaded connections between tubular members, wherein the electric tong system comprises a power tong for applying torque and rotating the upper tubular member, a backup tong for gripping tubulars, and a lift assembly for vertically moving the electric tong system into proper position to grip the upper and lower tubulars. The power and backup tongs and lift assembly of the electric tong system are integrated into a single transportable unit and operated by three separate electrical motors, controlled by a single driver. The backup tong is located below the power tong and comprises a pneumatic cylinder, which operates a backup door, and a linear actuator driven by an electric motor for use in latching the backup tong door in a closed position and applying or releasing a clamping force to a tubular, during make-up or break-out operations.

27 Claims, 19 Drawing Sheets

(56) References Cited

U.S. PATENT DOCUMENTS

| | | | | |
|---|---|---|---|---|
| 6,715,569 | B1 | 4/2004 | Rogers | |
| 6,748,823 | B2 | 6/2004 | Pietras et al. | |
| 6,752,044 | B2 | 6/2004 | Hawkins | |
| 6,892,835 | B2 | 5/2005 | Shahin et al. | |
| 6,966,385 | B2 | 11/2005 | Hemphill et al. | |
| 7,028,585 | B2 | 4/2006 | Pietras et al. | |
| 7,069,817 | B2 | 7/2006 | Wesch, Jr. | |
| 7,086,461 | B2 | 8/2006 | Schulze-Beckinghausen et al. | |
| 7,096,681 | B2 | 8/2006 | Wills et al. | |
| 7,104,316 | B1 | 9/2006 | Hobgood | |
| 7,191,686 | B1 | 3/2007 | Angelle et al. | |
| 7,281,451 | B2 | 10/2007 | Schulze Beckinghausen | |
| 7,370,707 | B2 | 5/2008 | McDaniel et al. | |
| 7,591,304 | B2 | 9/2009 | Juhasz et al. | |
| 7,631,581 | B2 | 12/2009 | Bangert | |
| 7,690,281 | B2 | 4/2010 | Hobgood | |
| 7,753,138 | B2 | 7/2010 | Juhasz et al. | |
| 7,757,759 | B2 | 7/2010 | Jahn et al. | |
| 7,775,270 | B1 | 8/2010 | Sipos | |
| 7,861,619 | B2 | 1/2011 | Stensland | |
| 7,891,418 | B2 | 2/2011 | Begnaud et al. | |
| 8,065,937 | B2 * | 11/2011 | Halse | E21B 19/165 81/57.33 |
| 8,109,179 | B2 | 2/2012 | Richardson | |
| 2003/0177870 | A1 * | 9/2003 | Neves | E21B 19/164 81/57.2 |
| 2004/0049905 | A1 * | 3/2004 | Jansch | E21B 19/164 29/428 |
| 2004/0188098 | A1 | 9/2004 | Schulze-Beckinghausen et al. | |
| 2004/0216890 | A1 | 11/2004 | Hemphill et al. | |
| 2005/0061112 | A1 | 3/2005 | Liess | |
| 2006/0081091 | A1 | 4/2006 | Wesch, Jr. | |
| 2006/0196316 | A1 | 9/2006 | Slettedal et al. | |
| 2008/0245192 | A1 | 10/2008 | Bangert | |
| 2008/0307930 | A1 | 12/2008 | Veverica et al. | |
| 2010/0199812 | A1 | 8/2010 | Richardson | |
| 2011/0030512 | A1 | 2/2011 | Begnaud | |
| 2012/0323500 | A1 | 12/2012 | Prefontaine | |
| 2012/0325017 | A1 | 12/2012 | Ruehmann et al. | |
| 2014/0041854 | A1 | 2/2014 | Robichaux et al. | |

* cited by examiner

ELECTRIC TONG SYSTEM AND METHODS OF USE

CROSS-REFERENCE TO RELATED APPLICATION

The present application is a non-provisional application that claims priority to a U.S. Provisional Application having U.S. Patent Application Ser. No. 61/893,819, filed Oct. 21, 2013, and U.S. Provisional Application having U.S. Patent Application Ser. No. 62/001,500, filed May 21, 2014, both of which are incorporated herein in their entireties by reference.

FIELD

Embodiments of the present disclosure relate, generally, to apparatus and methods for making up and breaking out wellbore tubulars and, more particularly, to an integrated, electric tong system and methods of use at a wellbore.

BACKGROUND

In the oil and gas industry, oil field tools, such as tongs or wrenches, are used to grip and rotate joints of tubulars (e.g., casing, drill pipe, other tubulars), particularly during makeup operations (e.g., threadably engaging, screwing together) or break-out operations (e.g., threadably disengage, unscrew). These oil field operations typically require a set of tongs, including an upper tong, which can be used to rotate an upper tubular for threadably connecting the upper tubular to, or removing the upper tubular from, a lower tubular, and a lower tong, which can be used to secure and hold stationary a lower tubular, to prevent its rotation in conjunction with the rotating upper tubular. The upper tong is commonly referred to in the industry as a power tong. The power tong comprises a mechanism or various components for gripping and rotating a tubular, while the body or housing of the power tong remains stationary. The lower tong is commonly referred to in the industry as a backup tong, and is used, as set forth above, for securing and holding a tubular stationary.

Typically, power tongs are hydraulically driven, which can include the use of hydraulic hoses connecting the power tongs to a hydraulic power unit or source for actuating or powering the jaws of the power tong. Valves are typically used to control the flow of hydraulic fluid or oil to the power tongs, for providing power to the power tong and gearbox, which in turn, operates the jaws of the power tongs for closing around a tubular and rotating the tubular. This type of hydraulic system, for powering the power tongs, can generally lack precision in the operation of the tongs, including the control of the speed of the rotation of the tongs and the torque applied to the tubular. In addition, this type of hydraulic system can pose environmental concerns, which can be associated with a leakage or spillage of the hydraulic oil.

In addition, the combinations of hydraulically powered power tongs and backup tongs are cumbersome and heavy tools. As such, hydraulic lift cylinders are typically required for moving and supporting the power and backup tongs, particularly when making up or breaking out a string of tubulars. Although existing units have combined a power tong with a backup tong, the lift cylinders are generally added, when rigging up in the field and operated separately.

Therefore, a need exists for an electric tong system that can be packaged and integrated into a single system, comprising a power tong, a backup tong, and a lift assembly, for minimizing rig-up time and expenses.

A need exists for an integrated electric tong system comprising a power tong, a backup tong, and a lift assembly, in which the motors for the power tong, backup tong and lift assembly can be operated and controlled by the use of a single driver. The electric tong system will enable greater precision in controlling the speed, torque, and direction of the rotation of the power tongs.

A need exists for an integrated electric tong system and methods of use comprising a power tong, backup tong and lift assembly, wherein the backup tong includes automated control for enabling greater precision in the movement of the backup tong components as well as the clamping and gripping of tubulars. In addition, a need exists for an automated electric tong system, comprising interlocking, capabilities for providing remote operation and additional safety features.

A need exists for an integrated electric tong system and methods of use comprising automation for remote operation of the electric tong system and for monitoring and analyzing the turns and torque data.

The embodiments of the electric tong system and methods of use meet these needs.

SUMMARY

Embodiments of the present disclosure relate, generally, to an integrated, electric tong system that can be usable for threading and unthreading tubular members at a wellbore. The electric tong assembly can include a frame assembly that can comprise an upper frame and lower frame, wherein the lower frame can include a first vertical member and a second vertical member. At least one actuator can be connected to the upper frame and the lower frame for moving the upper frame with respect to lower frame, and the at least one actuator can be driven by a first electric motor. In an embodiment, the at least one actuator is a linear actuator. In an embodiment, the upper frame can comprise a U-shaped frame that can be moved telescopically in relation to the lower frame.

The electric tong system can further include a backup tong that can be connected to the lower frame, wherein the backup tong can be driven by a second electric motor and can comprise a central opening for receiving a lower tubular member, such that the backup tong can receive, clamp and grip the lower tubular member during threading or unthreading operations. The electric tong system can further include a power tong that can be connected to the backup tong, and the power tong can include a central opening for receiving an upper tubular member. The power tong can be driven by a third electric motor and can be used for gripping and rotating the upper tubular member during threading or unthreading operations. In an embodiment of the electric tong system, a single driver is used for controlling the first electric motor, the second electric motor and the third electric motor of the electric tong system.

The power tong can include a housing that comprises an opening, and a rotary mechanism located within the housing that also comprises an opening. The power tong can further include a plurality of jaws and a ring gear that can be operably connected to the third electric motor of the electric tong system. The power tong housing can include a door that can be rotatably connected to the housing and located proximate to the opening of the housing, wherein the opening of the housing and the opening of the rotary mechanism can align to comprise the central opening of the power tong.

The power tong can further include a plurality of sensors that can be usable for sending a signal to actuate the plurality of jaws to secure the upper tubular member, when the openings of the housing and rotary mechanisms are aligned and the power tong door is closed. In an embodiment, the ring gear and rotary mechanism can be used to transfer torque from the third electric motor to the upper tubular member when the plurality of jaws are actuated.

The backup tong of the electric tong system can be usable for clamping and gripping a tubular member during threading and unthreading of the tubular member, for example, during make-up and break out operations. The backup tong can comprise a frame that partially defines a central opening that can receive the tubular member for threading or unthreading of the tubular. A door can be rotatably connected to the frame, and the door can rotate between an open position and a closed position, and partially define the central opening. A first linear actuator can be connected to the frame and to the door for use in rotating the door between the open position and the closed position. A latching arm can be rotatably connected to the frame, wherein the latching arm can latch the door in the closed position, and a second linear actuator can be connected to the frame and to the latching arm, wherein the second linear actuator an rotate the latching arm to latch the door in the closed position, and wherein the rotation of the latching arm progressively increases a force of contact between the door and the tubular member. The second linear actuator can be driven by an electric motor, and sensors can be operably connected to the first linear actuator and the second linear actuator for detecting the positions of the linear actuators and for activation/deactivation of the linear actuators.

The backup tong can further comprise a load cell, which can be located within the frame, and a J-shaped load transfer member that can include a first end connected to the load cell and a second end connected to the second linear actuator. In an embodiment, the load transfer member can be pivotably connected to the frame assembly and can transfer a proportion of force received from the second linear actuator to the capacity of the load cell.

In an embodiment of the backup tong, the frame can include at least one guide plate, and the second linear actuator can comprise at least one protrusion that can intersect with the at least one guide plate of the frame. In another embodiment of the backup tong, the central opening can be further defined by at least one gripping member for gripping the tubular.

Embodiments of the present invention can include a method for installing or removing a plurality of tubulars into or from a wellbore, respectively, wherein the method steps can include: positioning an electric tong system onto a joint of tubulars, wherein the electric tong system can include: a frame assembly; a backup tong comprising a first opening, a first door, and a latching arm; and a power tong comprising a second opening, a second door, and a plurality of jaws. The plurality of tubulars are generally joined into a continuous string whereby each joint of tubulars can include an upper tubular connected to a lower tubular with a connector.

The steps of the method can continue by adjusting the frame assembly for aligning the first opening of the backup tong with the second opening of the power tong. The aligned backup tong can grip the lower tubular, and the aligned power tong can grip the upper tubular. The method can further include closing the first door and second door, wherein the first door can trigger a linear actuator to compress the first door against the connector, and the second door can trigger the plurality of jaws to compress the upper tubular against a rotary mechanism and operably connect the rotary mechanism to an electric motor through a low transfer gear. The steps of the method can further include rotating the aligned power tong until the upper tubular is connected or disconnected from the lower tubular, and aligning the rotary mechanism with the second opening for opening the second door. The method can conclude by de-energizing the linear actuator to open the first door, and installing or removing the upper tubular into or from the wellbore. The method steps can be repeated, as needed, for installing or removing the plurality of tubulars into or from the wellbore, respectively.

In an embodiment, the step of closing the first door can further include actuating a second linear actuator, which can be connected to the frame assembly and to the latching arm, for rotating the latching arm to latch the first door in a closed position. The rotating of the latching arm can progressively increase a force of contact between the first door and the lower tubular.

In an embodiment, the interlock system of the electric tong system can include preventing the rotation of the aligned power tong, for disconnecting the upper tubular from the lower tubular, until after the first door has been closed. In addition, the interlock system can include locking the frame assembly in place and preventing any adjustments thereto until the first door has been opened. Further, the interlock system of the electric tong system can enable the performance of only one of the following steps at a time, including: adjusting the frame assembly, compressing the first door, or rotating the power tong.

BRIEF DESCRIPTION OF THE DRAWINGS

In the detailed description of various embodiments usable within the scope of the present disclosure, presented below, reference is made to the accompanying drawings, in which.

Figure 1:
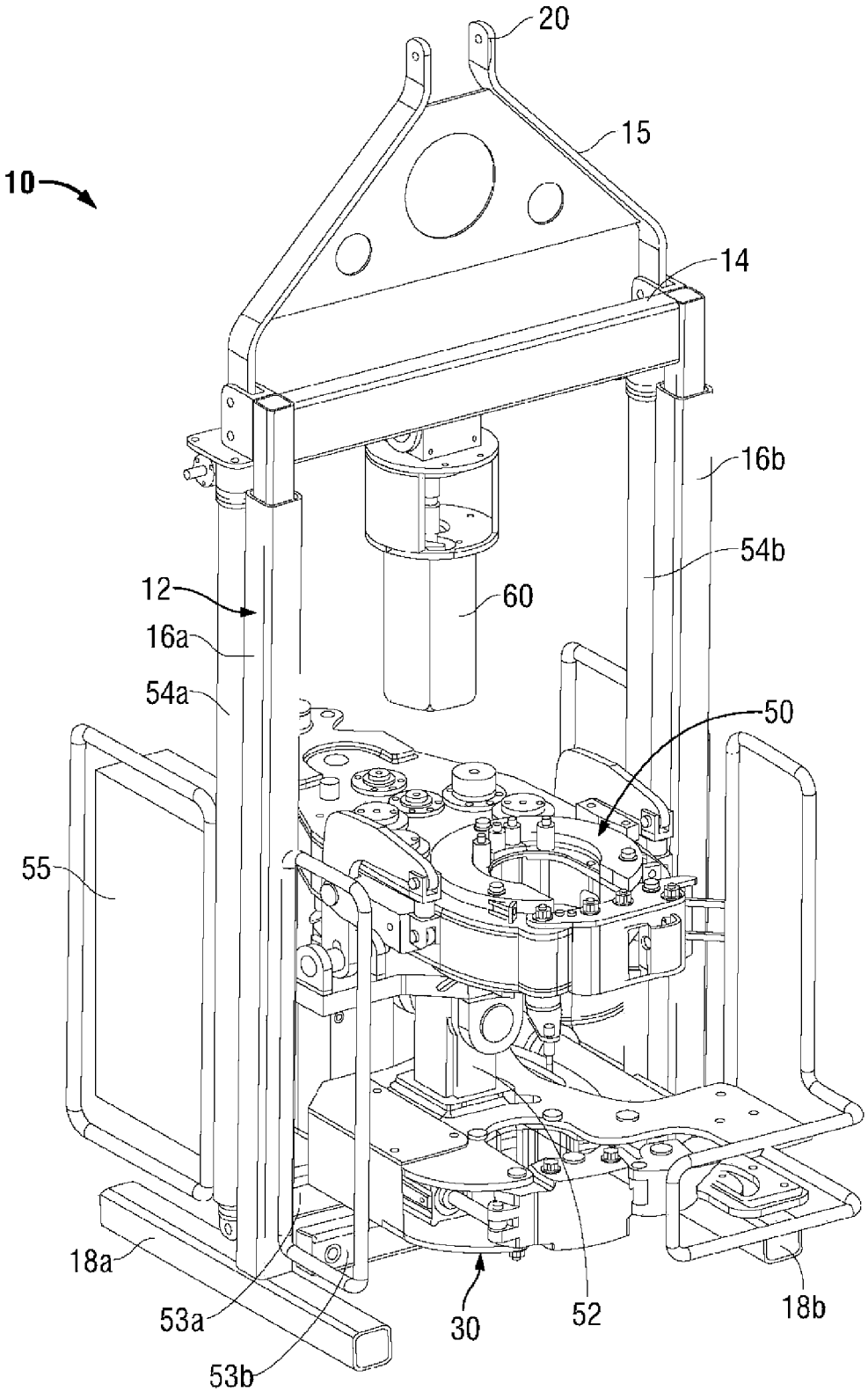
FIG. 1 is a perspective view of an electric tong system in accord with one embodiment of the present invention.

One or more embodiments are described below with reference to the listed Figures.

DETAILED DESCRIPTION

Before describing selected embodiments of the present invention in detail, it is to be understood that the present invention is not limited to the particular embodiments described herein. The disclosure and description of the invention is illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention.

As well, the drawings are intended to describe the concepts of the invention so that the presently preferred embodiments of the invention will be plainly disclosed to one of skill in the art, but are not intended to be manufacturing level drawings or renditions of final products and may include simplified conceptual views as desired for easier and quicker understanding or explanation of the invention. As well, the relative size and arrangement of the components may differ from that shown and still operate within the spirit of the invention as described throughout the present application.

Moreover, it will be understood that various directions such as "upper", "lower", "bottom", "top", "left", "right", "inward", "outward" and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Embodiments of the present disclosure relate, generally, to an apparatus and methods for making up and breaking out tubular joints and, more particularly, to an integrated, electric tong system and methods of use at a wellbore. The integrated electric tong system comprises a power tong, a backup tong, and a lift system (e.g., two actuators, a gearbox, a brake, an electric motor, interconnecting components and a telescopic frame), which are integrated into a single package and operated by electrical motors that can be controlled by a single driver.

The apparatus can include the use of switchgears and contactors for enabling the use of the single driver to control and operate the individual electric motors of the power tong, backup tong, and the lift system, as described above. The driver comprises the electronics and firmware required to control the speed and direction of the electric motor(s), and the driver can be housed in a separate aluminum box (i.e., driver box) that can be positioned in a safe area (i.e., nonhazardous area), away from the electric tong system.

The backup tong is located below the power tong of the electric tong system, and comprises a pneumatic cylinder for operation of a backup door. An electric motor can be mounted on the backup tong for operating a latch, located on the backup tong, which can be used for locking the backup door and applying a clamping force to a lower tubular during make-up or break-out operations. While the backup tong clamps and holds the lower tubular stationary, the power tong can rotate the upper tubular, which allows the power tong to apply torque to the connection joint between the upper tubular and the lower tubular.

The backup tong, which is used for the clamping of the lower tubular, can comprise a backup door(s) that can be closed pneumatically (i.e., use of a pneumatic cylinder) and tightened electrically. Specifically, an electric linear actuator can be used for applying a clamp force to the lower tubular, during make-up or break-out of the tubular joint connections. The clamp force can be sensed and measured by an electronic tension load cell that can be located in the backup tong and connected to a "J-shaped" member that can be pivotally connected to the backup case. A first end of the "J-shaped" member can be connected to the electrically-operated linear actuator, while a second end of the "J-shaped" member can be connected to the electronic tension load cell. The "J-shaped" member can be a lever that is used for proportioning the force from the electric linear actuator to the capacity of the electronic tension load cell.

The pneumatic backup door cylinder can comprise sensors, which can be used to detect when the clamping cylinder should actuate. The pneumatic backup door cylinder can further comprise a magnetic piston and two reed switches, wherein the reed switches are closed when the magnetic piston is moved near to them. When the backup door is closed, via the pneumatic cylinder, the reed switch, which is near the rod end of the pneumatic backup door cylinder, can become activated and the electric motor, which actuates a linear actuator, can become energized. The other reed switch can alert the backup control system when the backup door is open. The reed switches can also serve as position sensors on the pneumatic backup door cylinders. During an end-of-stroke condition, the electric linear actuator becomes de-energized, and a linear distance sensor, located on the piston end of the electric linear actuator, can be used for sensing rod position and, hence, an end-of-stroke condition.

In an embodiment of the electric tong system, the power tong can be located above the backup tong, and can be a conventional or hydraulic tong that is retrofitted to operate via an electric motor. The motor operating the power tong can be a servo-type motor that provides precise application of torque and speed. In an embodiment, the power tong is attached to a frame, which can be extended and retracted by an electrically operated lift system, as described above, for allowing vertical movement of the electric tong system.

Unlike conventional tongs, the automation of the electric tong system enables the operation of a selected sequence of functions through a single actuation (i.e., a push of a button can close the power tong door, latch the backup door and rotate the power tong). An operator box, which can be located at various positions on or about the electric tong system, including on the power tong, at the bottom of the tong, or on a floor stand, and remotely positioned with respect to the electric tong system, can be used to operate all of the functions on the electric tong system, including tong door open/close, backup open/close, lift up/down, high/low gear, rotate/cage plate align, manual/automatic mode, and make/break direction. In an alternative embodiment, the electric tong system can be operated remotely. A computer or computerized system can be used to monitor, receive and analyze the functions and output of the power tong, backup tong, and the lift cylinder of the electric tong system.

The automated and/or remote operation of the electric tong system provides many unique and/or safety features, including: (a) operation of the electric tong system from the rig floor or remotely (hand controller) to eliminate the need for an operator to be located on an operator stand (e.g., scaffolding) and the potential danger to the operator; (b) greater precision with regard to the control of the speed and direction of the motor(s) for the power tong and backup tong; (c) better torque control of the joint connection; (d) elimination of hydraulic power usage and related environmental issues; (e) safer operation during make-up and break-out operations by capability of an enhanced interlocking system; (f) Torque Turn system built into electric tong system for monitoring and analyzing data regarding the number of turns and the torque amount, with or without the use of a computer to record connections; (g) the transport footprint is about the same as a standard tong apparatus; (h) no side load reaction system; and (i) the ability to retrofit a conventional hydraulic tong with an electric motor and a gearbox to form the electric tong system.

Figure 2:
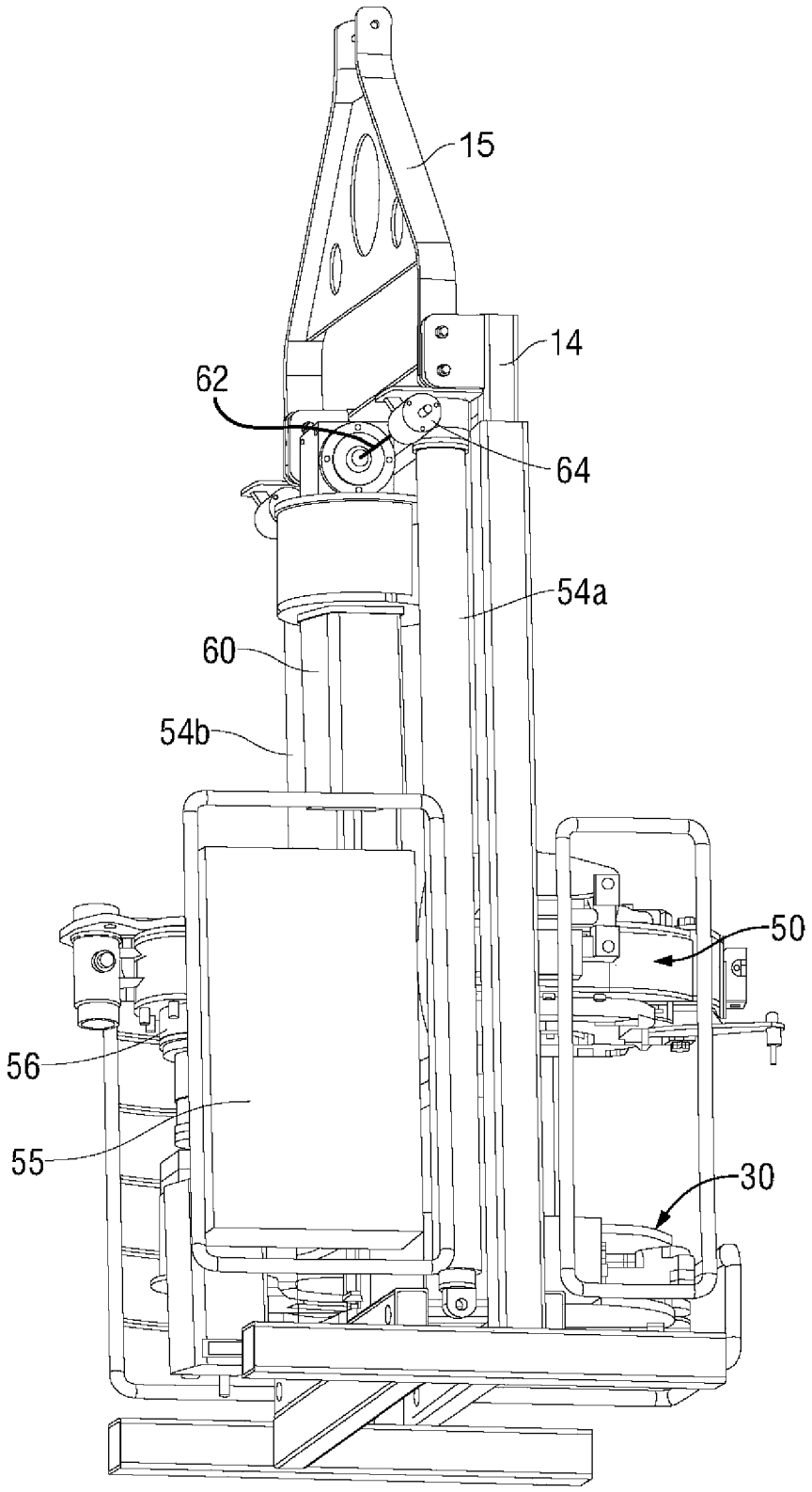
FIG. 2 is a perspective view of an electric tong system in accordance with one embodiment of the present invention.
Figure 16:
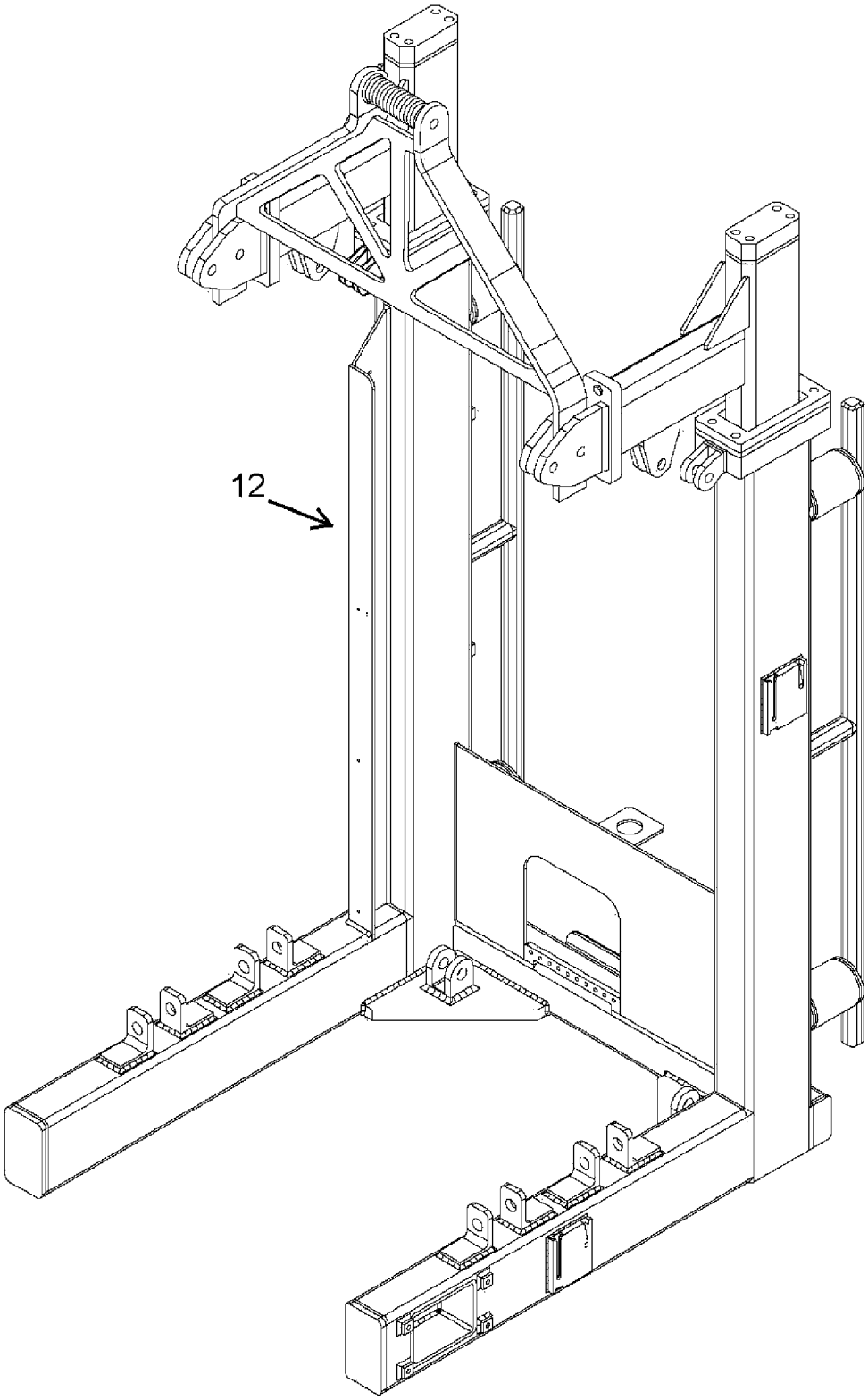
FIG. 16 is a perspective view of an embodiment of a frame assembly of the electric tong system, usable within the scope of the present invention.
Figure 17:
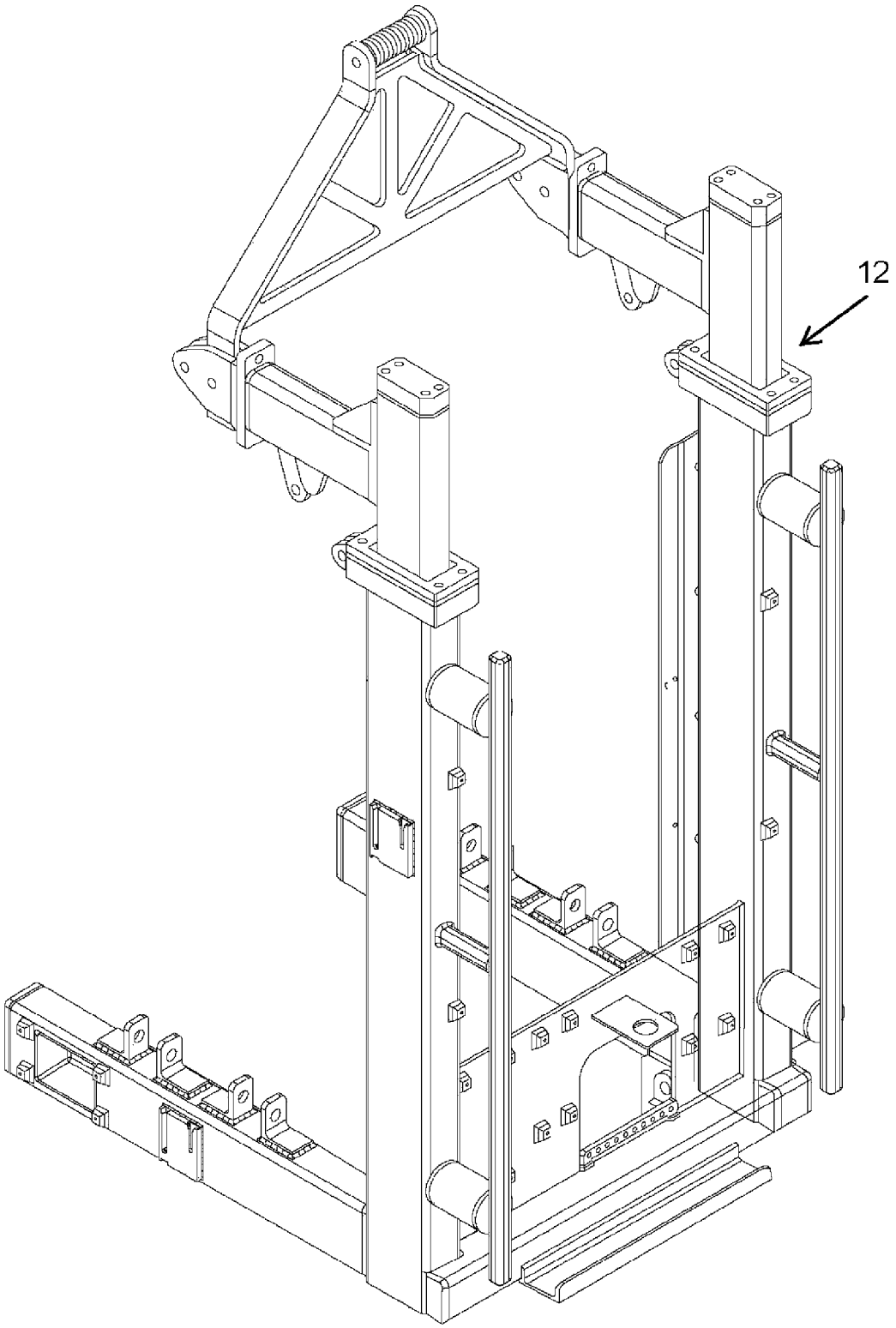
FIG. 17 is a perspective view of an embodiment of a frame assembly of the electric tong assembly, usable within the scope of the present invention.

Referring now to the drawings and more particularly to FIGS. 1-2, the Figures show an embodiment of a tong system (10) for making up or breaking out a string of tubulars, such as casing, drill pipe, or other tubulars. In this embodiment, the tong system or electric tong system (10) comprises a frame (12) that can comprise a generally U-shaped member (14) in telescoping engagement with frame members (16*a*, 16*b*), which can extend vertically in a generally parallel configuration. The frame may comprise horizontal base members (18*a*, 18*b*) that allow the electric tong system 10 to stand upright. The lower ends of the frame members (16*a*, 16*b*) may be rigidly attached to the base members (18*a*, 18*b*), while the upper ends of the frame members (16*a*, 16*b*) are attached to the U-shaped member, which can be connected to a lifting bracket (15). The frame members (16*a*, 16*b*) can be tubular or solid. Alternate embodiments of the frame assembly for the electric tong system are shown in FIGS. 16 and 17. The tong system (10) may be lifted via lifting lugs (20) through an adjustment screw formed on a top portion of the lifting bracket (15).

In this embodiment, a backup tong (30) is mounted to horizontal support beam(s) that attach(es) to the frame members (16*a*, 16*b*) and/or base members (18*a*, 18*b*). In an alternate embodiment, the backup tong can attach to a second or lower U-shaped member, which can attach to the lower end of the vertical frame members (16*a*, 16*b*) and/or the base members (18*a*, 18*b*). The backup tong (30), as shown in this embodiment of the electric tong system, will be further described in subsequent Figures. The power tong (50) and backup tong (30) can be connected to each other by a post (52) (e.g., torsion post), extending therebetween.

Conventional power tongs can include an "open throat" tong, in which the body and ring gear of the tongs have a window or opening for permitting a pipe or other tubular to be moved into and out of the central opening of the ring gear. Other conventional power tongs include a closed throat configuration, in which a pipe or other tubular must be inserted longitudinally into a ring gear opening. Open throat tongs typically have a gear train comprising two or more idler gears, while closed throat tongs may omit the idler gear(s) and drive the ring gear directly by the pinion gear. The idler gears are rotated, generally, by a gear that is rotated by a rotary power source, typically a hydraulic motor. The different gears, taken together, form a gear chain.

Power tongs generally comprise a housing, which can have a vertical slot with a vertical axis, which can be occupied by a pair of pipe or tubulars that are to be assembled or disassembled, during oil field operations. This type of power tong will generally have cam surfaces, disposed on the rotary gear, for moving the jaws, of a pair of jaw assemblies, in contact with a tubular. For example, drill pipe tongs often use hydraulic cylinders to engage the pipe, wherein a first set of hydraulic cylinders can include a pair of jaw assemblies usable to grip the pipe. The drill pipe tongs can also include a second set of hydraulic cylinders usable to rotate the pipe. A door, which is pivotally connected to the housing, may be closed during operation of the power tong. Each jaw assembly of a drill pipe tong can be powered, during a make-up or break-out operation, by one of said hydraulic cylinders, for gripping a first pipe and, thereafter, for positioning a second pipe for rotation. The pair of jaw assemblies can be mounted within cylindrical recesses provided, respectively, in the upper and lower portions of the housing. A pair of upper, laterally extending chambers and a pair of lower, laterally extending chambers can further comprise the housing.

In another arrangement, a conventional power tong can comprise a rotary, which is rotatably mounted in the housing. Relative rotation between the rotary and the housing can be inhibited by a device, such as a bolt, which is located on the power tong.

Other conventional power tongs can comprise two "passive" jaws that are fixed in the power tong, and a third "active" jaw that is advanced towards or retracted away from a pipe as desired. The active jaw may be mounted in a jaw holder, the radial extremity of which is provided with a roller which rests on a cam surface formed on a rotary. When the rotary rotates relative to the jaw holder, the roller rides along the cam surface and urges the jaw against the pipe with a force, which is a function of the slope of the cam surface. Once the jaw is firmly applied, the pipe and rotary rotate in unison. Power tongs may further use toothed dies, which are carried by the jaws, to transmit torque to the tubular connection. In yet another typical arrangement, the power tong may comprise a plurality of rollers that grip a pipe. The power tong may further comprise a belt(s), chain, and/or sprockets that function to rotate rollers or the rotary, depending on the arrangement.

Continuing with regard to the embodiment of the electric tong system, as shown in FIGS. 1 and 2, the embodiment includes the backup tong connected to the power tong by a lower end of a torsion post (52), which, as shown in FIG. 1, extends through a proximal end of the backup tong (30) and fixedly engages therewith. As shown in this embodiment, two support beams (53*a*, 53*b*) can connect the backup tong to the base members (18*a*, 18*b*). Two lift cylinders (54*a*, 54*b*) are shown extending between the base members and the U-shaped frame member (14). As depicted in FIG. 1, the lower ends of the lift cylinders (54*a*, 54*b*) may be connected to the base members (18*a*, 18*b*), while the upper ends of the cylinders are connected to the U-shaped frame member (14), whereby the extension of the lift cylinders (54*a*, 54*b*) can vertically extend the U-shaped frame member (14) from within the frame members (16*a*, 16*b*). The terms "backup" and "backup tong" are used interchangeably throughout this application for referring to the backup tong.

An electric motor (56, shown in FIG. 2), for example a servo-type motor, can be used to operate the power tong (50) for rotating or spinning a tubular during make-up or break-out operations. Once the lower tubular (e.g., casing, drill pipe or other tubular not shown) is gripped by the backup tong and the upper tubular is shouldered, the electric motor (56), located on the power tong (50) can apply high torque at a low speed to make-up a joint connection between the upper and lower tubulars. The electric tong system can comprise a first electric motor ((60), shown in FIG. 2) for moving the upper frame with respect to the lower frame for lifting purposes, a second electric motor ((82), shown in FIGS. 6*a* and 6B) usable for back-up tong (30, shown in FIG. 2) operations, and a third electric motor (56) usable for power tong (50) operations. The electric motor (56), located on the power tong (50), can also operate to apply high torque at a low speed to break-out a joint connection, or operate at high speed and a low torque to unthread a tubular from a joint connection. Typically, for a 7⅝" electric tong, the low gear provides a torque of about 30,000 ft-lb (Int.)/8,570 ft-lb (Cont.) at a speed of 5 RPM, while the high gear provides a torque of 10,000 ft-lb (Int.)/2,860 ft-lb (Cont.) at a speed of 25 RPM. Such a tong can weigh about 3000 lbs., have overall dimensions of 36"×60"×80", and be classified for a Zone 1, Class 1, Division 1, Operating Area.

Referring to FIG. 2, the Figure shows an embodiment of the electric tong system wherein a motor, for example an electric motor (60) as shown in FIGS. 1 and 2, can be mounted to a horizontal upper portion of the U-shaped member (14). In this embodiment, the electric motor (60) drives a shaft (62), via an intermediate transmission, wherein the shaft, in turn, actuates the lift cylinders (54*a*, 54*b*). The depicted lift cylinders include actuators, (e.g., ball screw type linear actuators), each comprising an internal ball screw extending through the external cylindrical body, wherein rotation of an internal worm gear rotates the ball screw, causing it to extend from the cylindrical body.

In another embodiment of the electric tong system and as shown in FIG. 2, the lift cylinders can include an internally threaded sleeve, which can extend longitudinally through a cylindrical body, wherein rotation of the sleeve can force an internal shaft to extend from the cylindrical body. When the electric motor (60) is energized, the gear assembly (64) can engage the internal shaft of each of the lift cylinders (54*a*, 54*b*), causing the internal shafts of the lift cylinders (54*a*, 54*b*) to extend. As the internal shafts of the lift cylinders extend or telescope outwardly, the lift cylinders (54*a*, 54*b*) can extend the U-shaped member. Alternatively, as shown in FIG. 2, as the internal shafts of the lift cylinders retract or telescope inwardly, the lift cylinders can retract the U-shaped member into the frame members (16*a*, 16*b*). Therefore, when lifting lugs (20) of a lifting bracket (15) are attached to an external lift (e.g., crane or other external lift, not shown), the electric tong system (10) can be lifted or lowered to a desired height by retracting or extending the internal shafts of the lift cylinders (54*a*, 54*b*).

As further depicted in FIGS. 1-2, an enclosure or box (55) may be mounted to the frame (12) of the electric tong system to house such components as motor contactors, resolver relays, barriers, input/output modules, a controller, an alphanumeric display, and several switches. The controller can receive input from an operator box, located on the electric tong system or remotely, such as on a stand on the rig floor, and the controller can send commands to all outputs for various operations and functions of the electric tong system. The operator box can comprise seven toggle switches mounted to the box for operating various functions, including open/close of power tong door, open/close of backup tong door, up/down movement of lift assembly, high/low gear operation, rotate/cage plate alignment, changing from manual to automation mode and vice versa, and change from make-up to break-out direction and vice versa.

Figure 3:
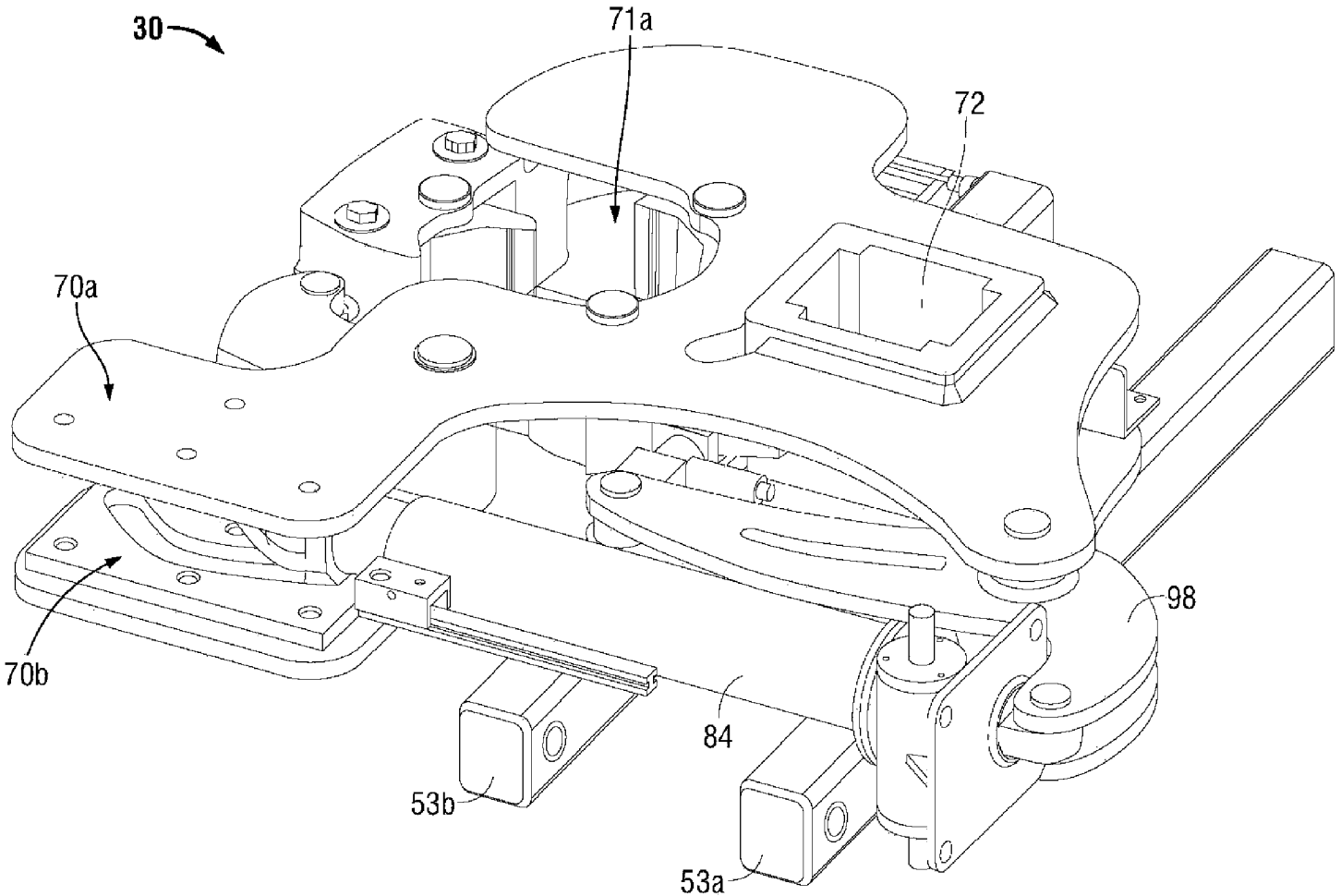
FIG. 3 is a perspective view of a backup tong in accordance with one embodiment of the present invention.
Figure 4:
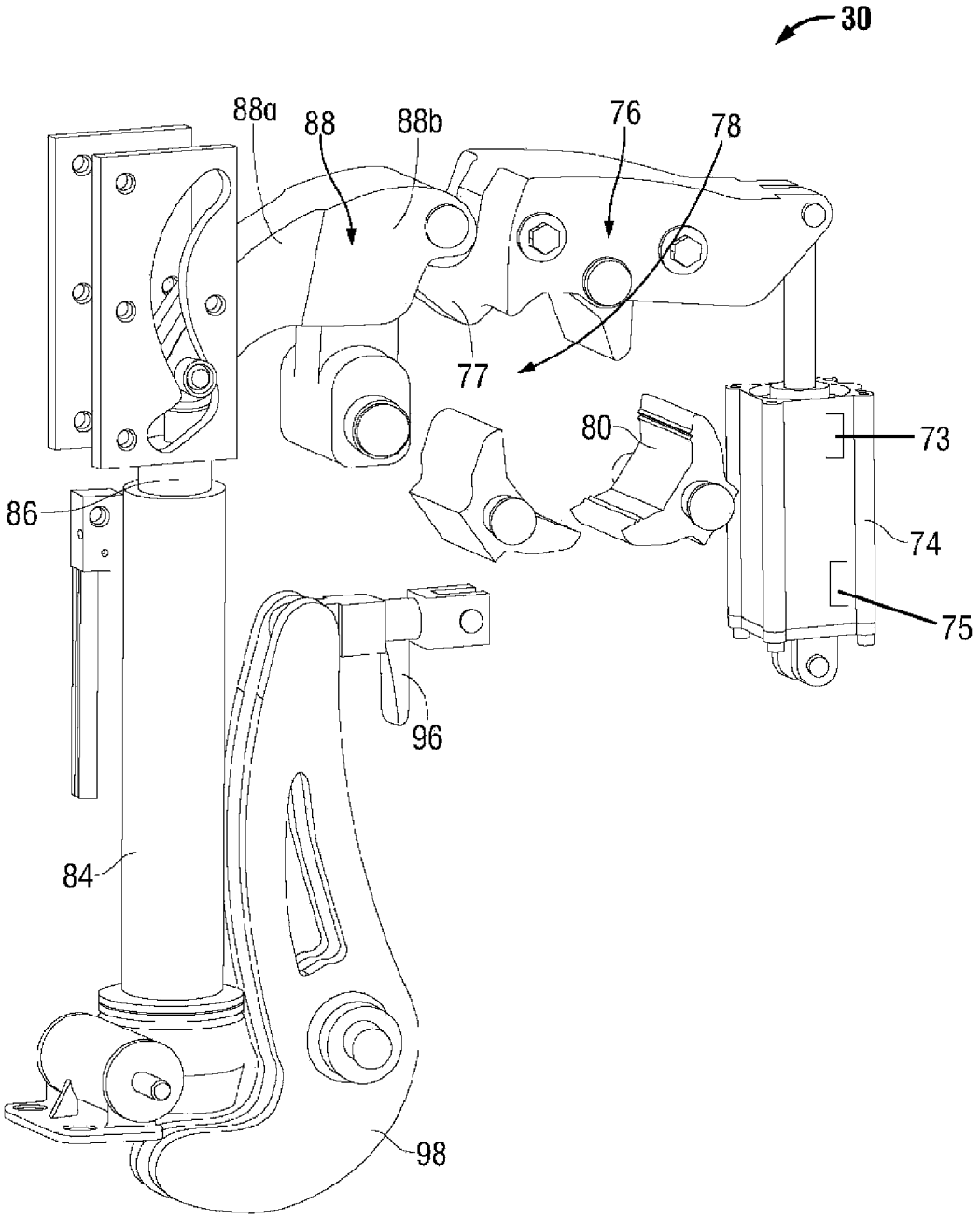
FIG. 4 is a perspective view of a backup tong in accordance with one embodiment of the present invention.
Figure 5:
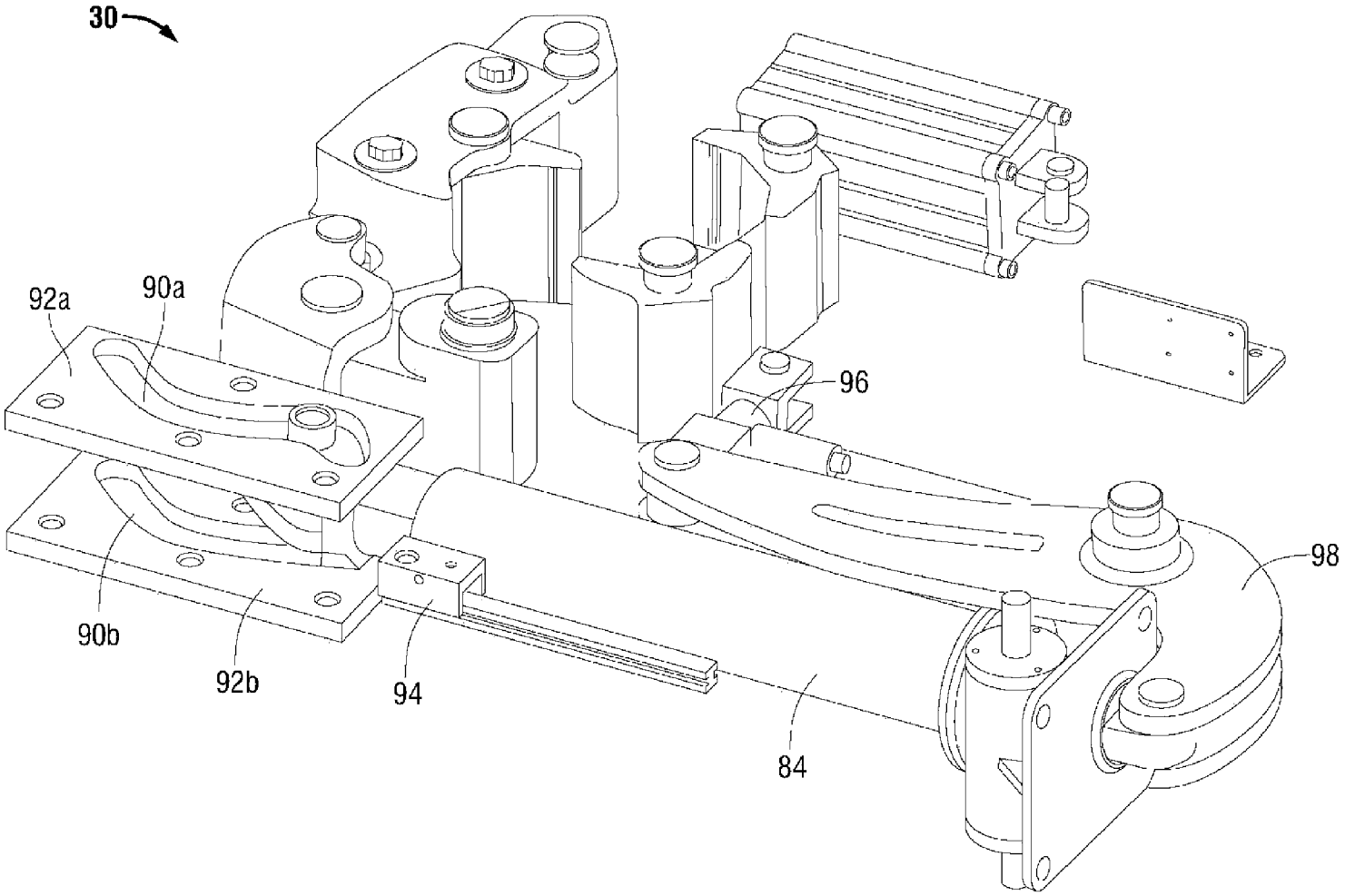
FIG. 5 is a partial cutaway view of the backup tong of FIG. 3 in accordance with one embodiment of the present invention.

FIGS. 3-5 depict an embodiment of the backup tong (30). As depicted in FIGS. 3 and 4, the backup tong (30) can comprise an upper and a lower case (70*a*, 70*b*) respectively, which is depicted as upper and lower plates that are positioned horizontally in a generally parallel configuration, wherein the upper and lower cases form the frame of the backup tong (30). The front end of each case can comprise a cavity (71*a* shown in FIG. 3, and 71*b* not shown) that defines a throat (78, shown in FIG. 4) of the backup tong, wherein the throat can be adapted to accept the lower tubular (not shown) during operations. As further depicted, the upper and lower cases can have an opening 72 for receiving the lower end of the post ((52), shown in FIG. 1).

As shown in FIG. 3, the lower case (70*b*) can be connected to the support beams (53*a*, 53*b*), which can be usable to connect the backup tong (30) to the base members (18*a*, 18*b*) or to other portions of the frame (12). As shown in FIG. 4, a pneumatic backup door actuator or cylinder (74) may be mounted on a side of the backup tong (30) for opening or closing the backup door (76) on the backup tong (30). In this embodiment, the backup door (76) can be opened to receive a tubular within the throat area (78), further defined by two gripping members (80) that can be pivotally connected between the cases (70*a*, 70*b*). The backup door (76) can be pivotally connected to the cases by a pin extending between the cases (70*a*, 70*b*), at the front end thereof. As depicted, one end of the door can pivotally connect to the pneumatic backup door cylinder (74), while the opposite end of the door can comprise a hook-like protrusion (77) that can be usable for latching against a clamping jaw (e.g., a latch arm).

As set forth above, a sensor, which can detect when the clamping cylinder (84) should actuate, is located on the pneumatic backup door cylinder (74). The pneumatic backup door cylinder (74) may have a magnetic piston. Attached to the body of the pneumatic backup door cylinder (74) are two reed switches (73, 75). The reed switches are closed when the magnetic piston is located near them. When the backup door (76) is closed via the pneumatic backup door cylinder (74), the reed switch (73) that is near the rod end of the pneumatic cylinder (74) can become activated, which, in turn, enables the electric linear actuator or clamping cylinder (84) to become energized. The other reed switch (75) can be used to signal the control system that the backup door (76) is open. The reed switches can also function as position sensors.

FIG. 5 depicts a cutaway view of the backup tong depicted in FIG. 3, with the upper case (70*a*) not shown for additional clarity. As depicted in FIG. 5, a rod end (86, shown in FIG. 4) of a clamping cylinder or linear actuator (84) can travel along curved channels (90*a*, 90*b*) of the guide plates (92*a*, 92*b*) during operation, wherein the guide plates (92*a*, 92*b*) can be positioned between the backup cases (70*a*, 70*b*, see FIG. 3). As the shaft moves outwardly from the clamping cylinder (84) at the rod end (86), the protrusion (88*b*) of the clamping jaw (88) can exert a clamping force on the corresponding protrusion (77) of the backup door (76). As the backup door (76) is forced toward the center of the throat (78), the tubular located within the throat (78), is increasingly compressed. A position sensor (94) can be mounted on a rail near the rod end (86). The position sensor (94) can be used to determine the extension of the clamping actuator (84).

As shown in FIG. 5, the clamp force, which can be exerted by the clamping jaw (88) on the tubular, may be measured and sensed by means of an electronic tension load cell (96, also shown in FIG. 4) located in the backup tong (30). The load cell (96) can be connected to a 'J'-shaped member (98, also shown in FIG. 4) that is pivotally connected to the backup tong (30) case. One end of the 'J'-shaped member (98) can be connected to the back end of the actuating clamping cylinder (84), and the other end of the 'J'-shaped member (98) can be connected to the load cell (96). This 'J'-shaped member (98) can function as a lever for transferring and proportioning the actuator force to the capacity of the load cell (96).

Figure 6A:
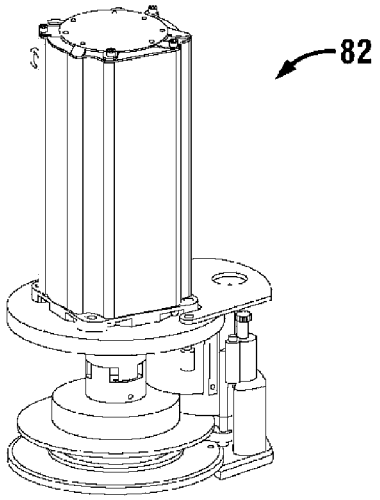
FIG. 6A is a perspective, cutaway view of an electric motor and brake assembly for a backup tong in accordance with one embodiment of the present invention.
Figure 6B:
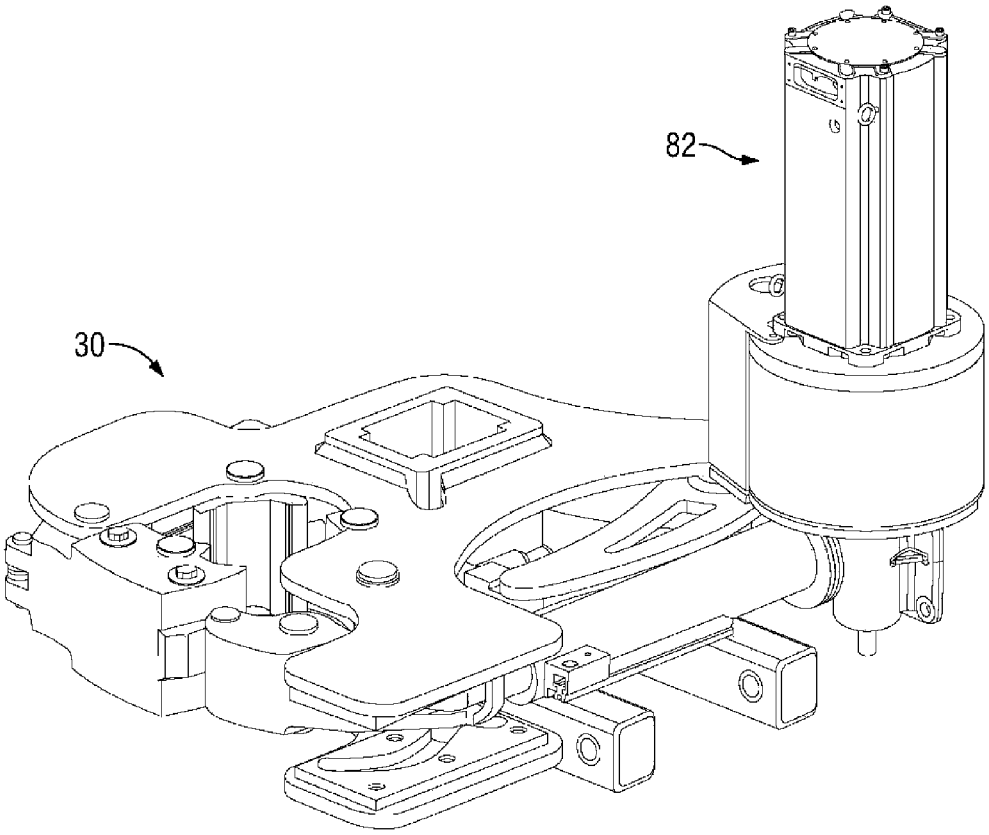
FIG. 6B is a perspective view of a backup tong with an electric motor and brake assembly in accordance with one embodiment of the present invention.

When the backup door (76) of the backup tong (30) is in a closed position, an electric motor and brake assembly (82), depicted in FIGS. 6A-6B, can actuate the clamping cylinder (84). In the embodiment shown in FIG. 4, the rod end (86) of the clamping cylinder or linear actuator (84) can be connected to a clamping jaw or member (88). The clamping jaw (88) can be pivotally connected between the backup cases (70*a*, 70*b*, as shown in FIG. 3) and can comprise a lever portion (88*a*) that is pivotally connected to the rod end of the clamping cylinder (84) and a hook-like protrusion (88*b*) that is located opposite the lever portion, wherein the hook-like protrusion (88*b*) can be curved in the opposite direction from the protrusion (77) located on the backup door (76).

Figure 6D:
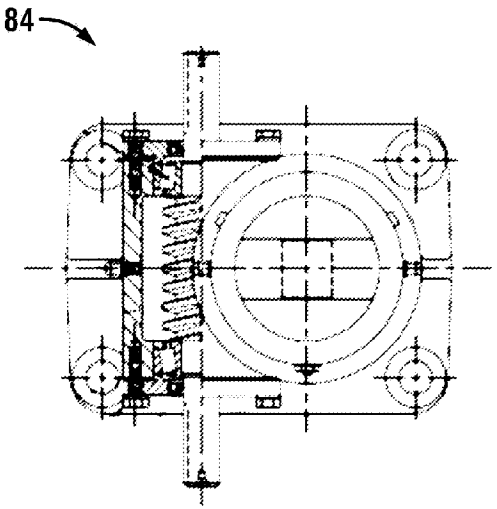
FIG. 6D is a sectional end view of a gear actuator in accordance with one embodiment of the present invention.
Figure 6C:
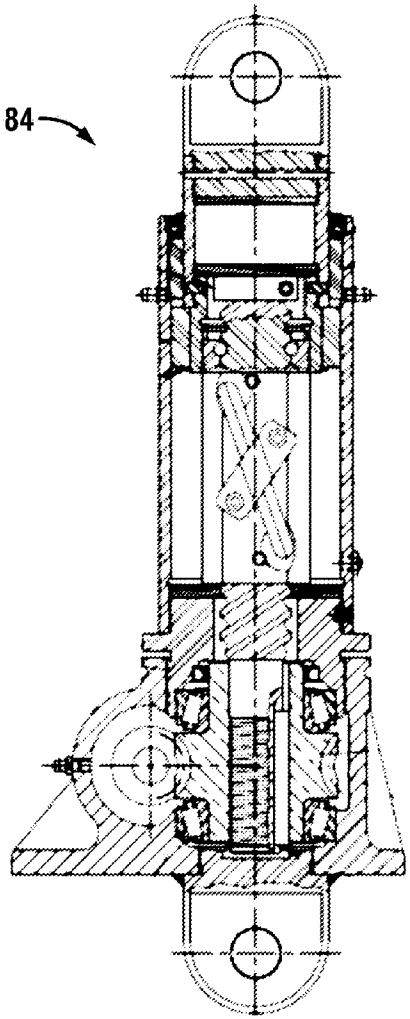
FIG. 6C is a sectional view of a gear actuator in accordance with one embodiment of the present invention.

FIGS. 6C and 6D show a cross-sectional and an end sectional view, respectively, of an embodiment of the clamping cylinder (84). In this embodiment, the gear mechanism, utilized within the clamping cylinder (84), is a ball screw type linear actuator.

As shown in the embodiments of FIGS. 3-5, the backup tong (30) has considerable advantages to a conventional backup tong. For example, the conventional backup tong is operated by hydraulic power and utilizes multiple hydraulic cylinders. Typically, a first cylinder operates a first door member or jaw, a second cylinder operates a second door member or jaw, and a third cylinder operates a latch for locking the door members. Finally, a fourth cylinder operates to tighten the throat area for applying the clamping force to a tubular member.

In contrast, the backup tong (30) of the present invention, as particularly shown in FIGS. 3-5, utilizes one pneumatic cylinder (74) to operate the backup door (76) and includes an electric motor (82) for applying the clamping force, as described above. In addition, the backup tong (30) of the present invention utilizes less moving parts and eliminates the need for a hydraulic power source, thereby lowering costs, as a single linear actuator (84) and a single clamping jaw (88) can be used to latch the door (76) in a closed position and to apply compression to a tubular in a single action.

Figure 7A:
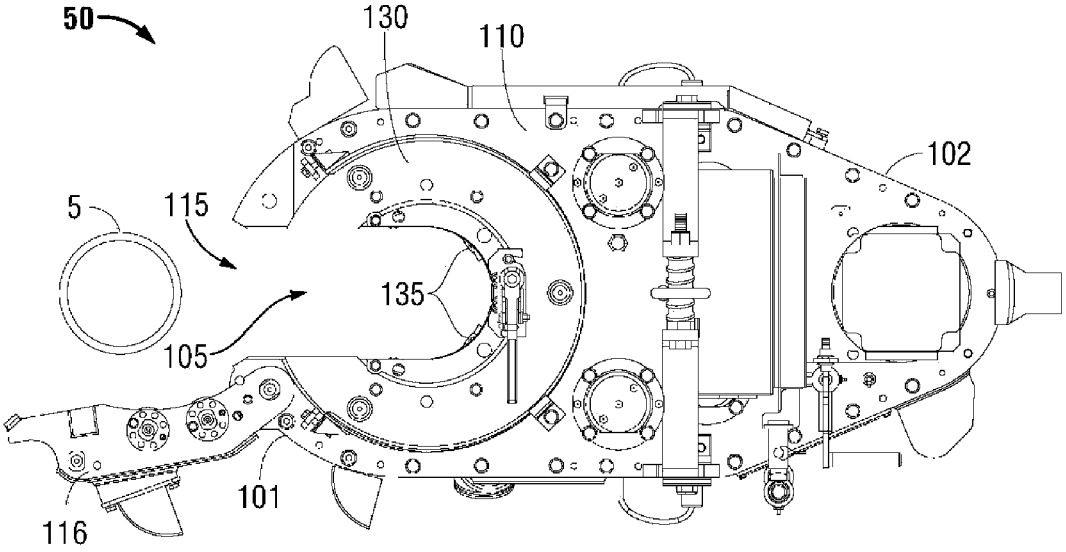
FIG. 7A is a plan view of an open power tong and tubular in accordance with one embodiment of the present invention.
Figure 7B:
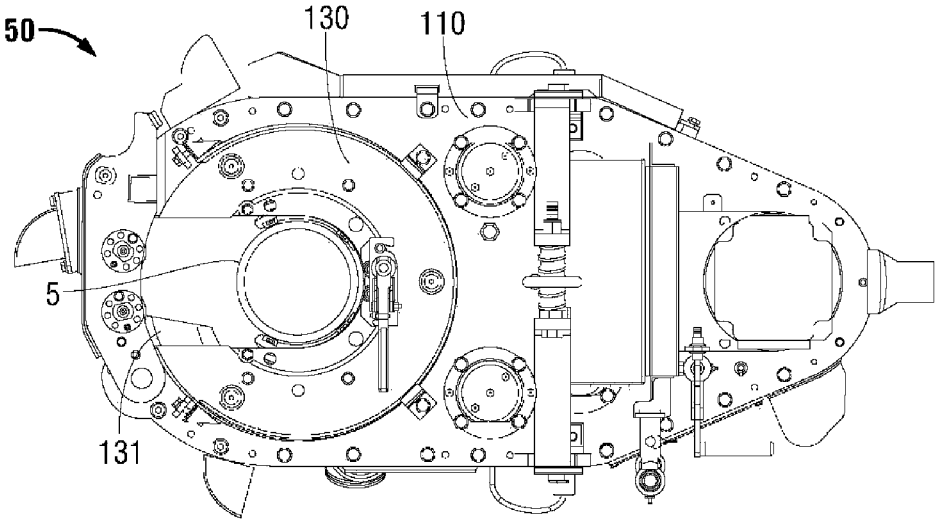
FIG. 7B is a plan view of a closed power tong and tubular in a reset position in accordance with one embodiment of the present invention.

Turning now to FIG. 7A, an embodiment of the power tong (50) of the present invention is shown in additional detail. The power tong (50) can include an "open throat" tong, comprising a rotating mechanism (130), often referred to as a "ring gear section" or a "rotary jaw section," that can be positioned within the power tong housing (110). The power tong housing (110) can comprise a front opening (115) at the front end (101) of the power tong (50), and the rotating mechanism (130) can comprise an opening or a window, referred to as a throat (105), on one side thereof, for permitting a pipe or other tubular (5, as shown in FIGS. 7A and 7B) to be moved into and out of the rotating mechanism (130). During make-up and break-out operations, the internal rotating mechanism (130) can grip and rotate a tubular (5), while the housing (110) of the power tong (50) can remain stationary.

The power tong (50) can be driven by an electric motor (56), which is not shown here for clarity but depicted in FIG. 1, that can be operatively connected to the rotating mechanism (130) and mounted at the back end (102) of the housing (110). The power tong (50) can comprise an internal gear train (not shown) positioned within the housing (110), wherein the gear train can comprise a plurality of idler gears (not shown) which can transfer torque from the electric motor to a ring gear (131, see FIG. 7B) of the rotating mechanism (130). In an embodiment of the power tong (50), the electric motor (56) can further operate the jaws (135) for closing around a tubular (5).

During make-up and break-out operations, the tubular (5) can be positioned at the center of the rotating mechanism (130), provided the rotating mechanism (130) is rotated such that its throat (105) is aligned with the front opening (115) in the housing (110), as shown in FIG. 7A. Hereinafter, such aligned position will be referred to as the "reset position." Once the tubular (5) is positioned within the center of the rotating mechanism (i.e., at the end of the throat (105)), the door (116) can be closed and the jaws (135) can be closed around the tubular (5), as shown in FIG. 7B. At this time, the electrical motor (56), located on the power tongs, can be activated to rotate the ring gear (131, as shown in FIG. 7B) and the rotating mechanism (130), for rotating the tubular (5).

During the torqueing portion of the make-up and break-out operations, a plurality of pressure and position sensors (not shown) can continuously transmit electrical torque and rotation signals to the electronic control system (to be described later). When the desired torque is imparted to the tubular (5), or if the desired number of rotations of the tubular (5) is reached, the jaws (135) automatically release and the rotating mechanism (130) reverses until its throat (105) is aligned with the front opening (115) of the housing (110).

The electronic control of the power tong (50) can be further adapted with a reset function, whereupon receiving an electrical signal, the electronic control system can cause the electrical motor to reverse direction of rotation and orient the rotating mechanism (130) to its reset position. In an embodiment, the reset function is initiated by a button on an operator box ((392), not shown here but depicted in FIG. 8) or by movement of a lever, causing an electrical signal from the operator box (392) or lever to transmit a signal causing the return of the rotating mechanism (130) to the reset position.

Figure 8:
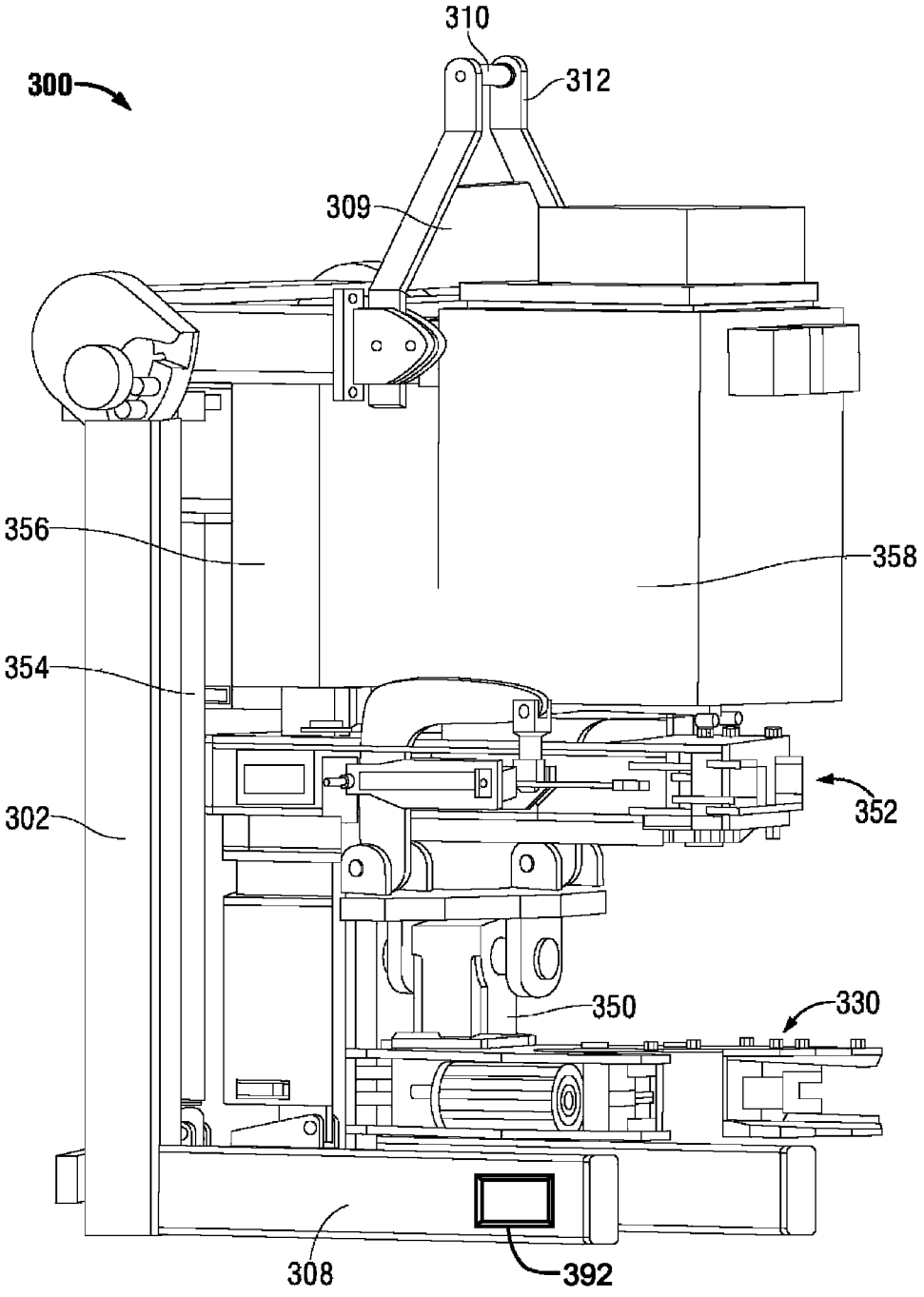
FIG. 8 is a perspective view of an electric tong system and driver box in accordance with one embodiment of the present invention.

In another embodiment, as shown in FIG. 8, the electric tong system (300) for use in making-up or breaking-out a string of tubulars, can comprise a frame that may further comprise a first generally U-shaped member that is in telescoping engagement with two vertical frame members, and a base (308) that connects to the two vertical frame members and allows the electric tong system (300) to stand upright. The tong system (300) may be lifted via a lifting member (310) that can be attached between the lifting lugs (312), which are formed on a top portion of the lifting bracket (309).

In this embodiment, a backup tong (330) is mounted to a post (350) (e.g., torsion post). The backup tong (330) is similar to the backup tong disclosed in FIGS. 3-5. A power tong (352) may also be connected with the torsion post (350), wherein the torsion post (350) can extend through and above the backup tong (330). The power tong (352) may be a conventional power tong that is retrofitted with an electric motor. As shown in FIG. 8, a lower end of the torsion post (350) can traverse a proximal end of the backup tong (330), and the lower ends of the lift cylinders (354) may be connected to the base (308) of the frame while the upper ends of the lift cylinders (354) are connected to the generally U-shaped member Electric motors can be used for powering the power tong (352), backup tong (330), and lift cylinders (354), and are similar to those described in FIGS. 1-2 and FIGS. 3-5. An enclosure or box (356) may be mounted to the frame to house a switchgear, wherein the box (356) can be used to control and protect onboard electrical equipment.

Further, FIG. 8 shows a driver box (358), which can be attached to the frame (302), that includes the motor driver. As previously set forth, the motors for the power tong, backup tong, and lift assembly are controlled by the use of a single driver, which enables greater control and operation of the integrated package of the power and backup tongs and the lift assembly. In addition, the use of servo motors, controlled by a single driver, provides greater control of the speed and direction of the power tong. FIG. 8 also shows that the integrated electric tong system (300) can be packaged and can comprise a transport footprint that is about the same as a standard tong, which enables easy transport, installation and removal of the electric tong system (300).

In an embodiment, the electric tong system (300) additionally includes an operator box (392) for controlling various functions of the tong system (300). The operator box (392) may be located at various positions on or about the electric tong system (300), including at the base (308) of the electric tong system (300), such that its location can eliminate the need for the operator to use a tong stand, thus providing an important safety feature. The operator box (392) may comprise seven toggle switches, which can be used for controlling the functions of the electric tong system (300), including: open/close power tong door, open/close backup tong door, up/down of lift, high/low gear, rotate/cage plate alignment, manual/automatic mode of operation, and make-up/break-out direction.

Figure 9:
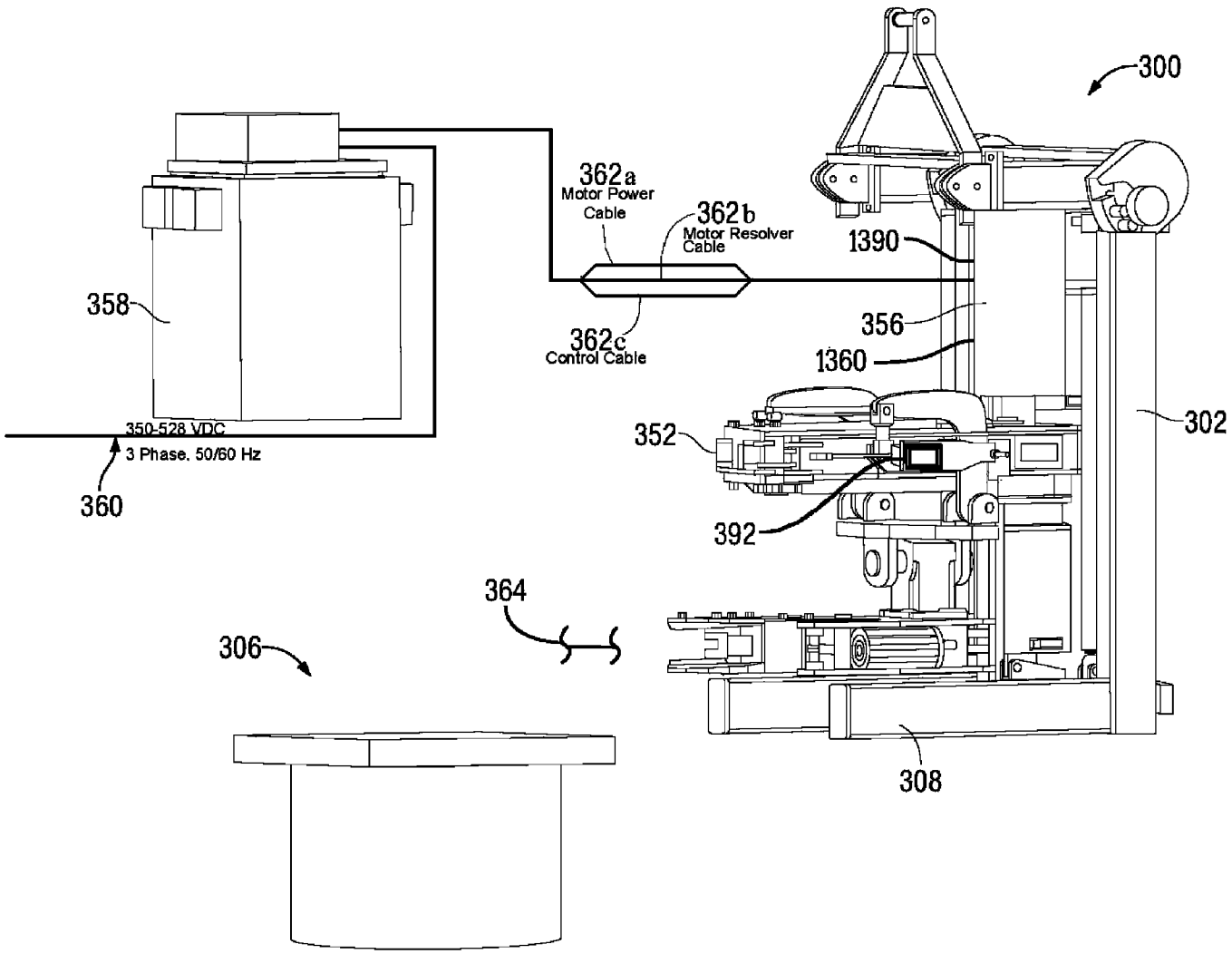
FIG. 9 is a perspective view of an electric tong system, driver box, and flush mounted spider in accordance with one embodiment of the present invention.

As depicted in FIG. 9, the driver box (358) is not fixed in place and may be installed at a distance from the electric tong system (300). The driver box (358) may be constructed from aluminum and is generally located in a "safe" area (nonhazardous area). Control of the electrical equipment, including the servo motors, is provided via the driver and other components within the driver box (358). The driver box (358), as shown in FIG. 9, can receive alternating current (AC) 3 phase, with a voltage of 350-528 VAC and a frequency of 50/60 Hz, power via cables (360) connected to an electrical power source. In this embodiment, three cables (362) can connect the driver box (358) to a switchgear box (356) that is mounted on the electric tong system (300). The cables (362) (e.g., motor power cable, motor resolver cable, and control cable) can include and provide motor power, resolver, signal and 24 VDC. In addition to these electrical connections, the electric tong system (300) can require an air line(s) (364) for supplying air to the pneumatic cylinders of the backup tong. In the embodiment shown in FIG. 9, the air line(s) (364) can attach to a pressure regulator, which can be located on the back of the electric tong system (300), for supplying air to all of the pneumatic actuators, valves, and the purge system. The air may be supplied by a rig or other source. After all connections are made and purging is complete, a cable or tong hanger line can be attached to the electric tong system (300) to support the electric tong system (300). In this embodiment, the driver box (358) houses the single driver that includes the electronics and firmware required to control the speed and direction of the motors. In contrast, a conventional tong system does not include a single driver for controlling several motors, as only the power tong includes the use of an individual motor. Although a backup tong can be coupled to the power tong in some conventional tong systems, the back-up tong is not powered by a separate motor. Further, the lift assembly is not integrated with the power and backup tongs in a conventional tong system.

Additionally, the embodiment depicted in FIG. 9 is shown with the operator box (392) located on a side of the electric power tong (352), which can be possible when the electric tong system (300), for example, is operated with a flush mounted spider (FMS) (306), as the connection to be made is not high above the rig floor.

It can of course be appreciated that the positioning of the operator box (392) is not limited to the depicted embodiments located on the base (308) or the side of the electric power tong system (300), but may be positioned anywhere on the apparatus as is convenient to the operator and required by the one of ordinary skill in the art. In an alternate embodiment, the operator box (392) can be located on a stand on the rig floor, which is positioned away from the electric tong system (300), for enabling the operator to be located remote to the electric tong system (300). This remote placement of the operator box (392) provides an enhanced safety feature with regard to the operation of the electric tong as it eliminates the need for the operator to be positioned on an operator stand (e.g., scaffolding), located above and/or adjacent to the electric tong system (300).

Figure 10:
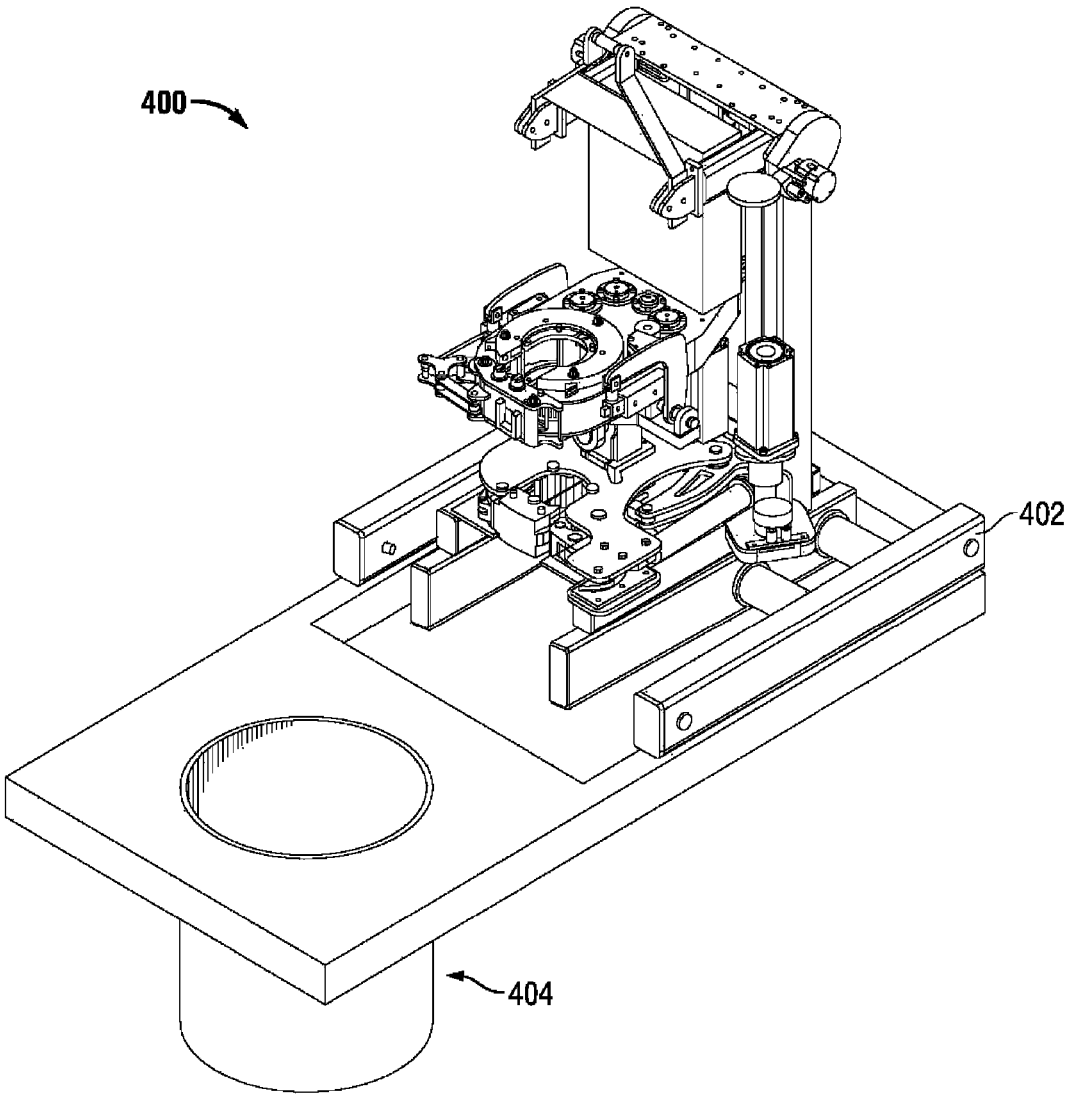
FIG. 10 is a perspective view of a remote electric tong system in accordance with one embodiment of the present invention.

In another embodiment, as shown in FIG. 10, the electric tong system (400) can be packaged, and can function with a remote tong system (RTS), such that the use of a car or a plurality of rails (402) can move the entire electric tong system (400) to and from a center of a wellbore (404) for easy installation and removal of the electric tong system (400).

Figure 11:
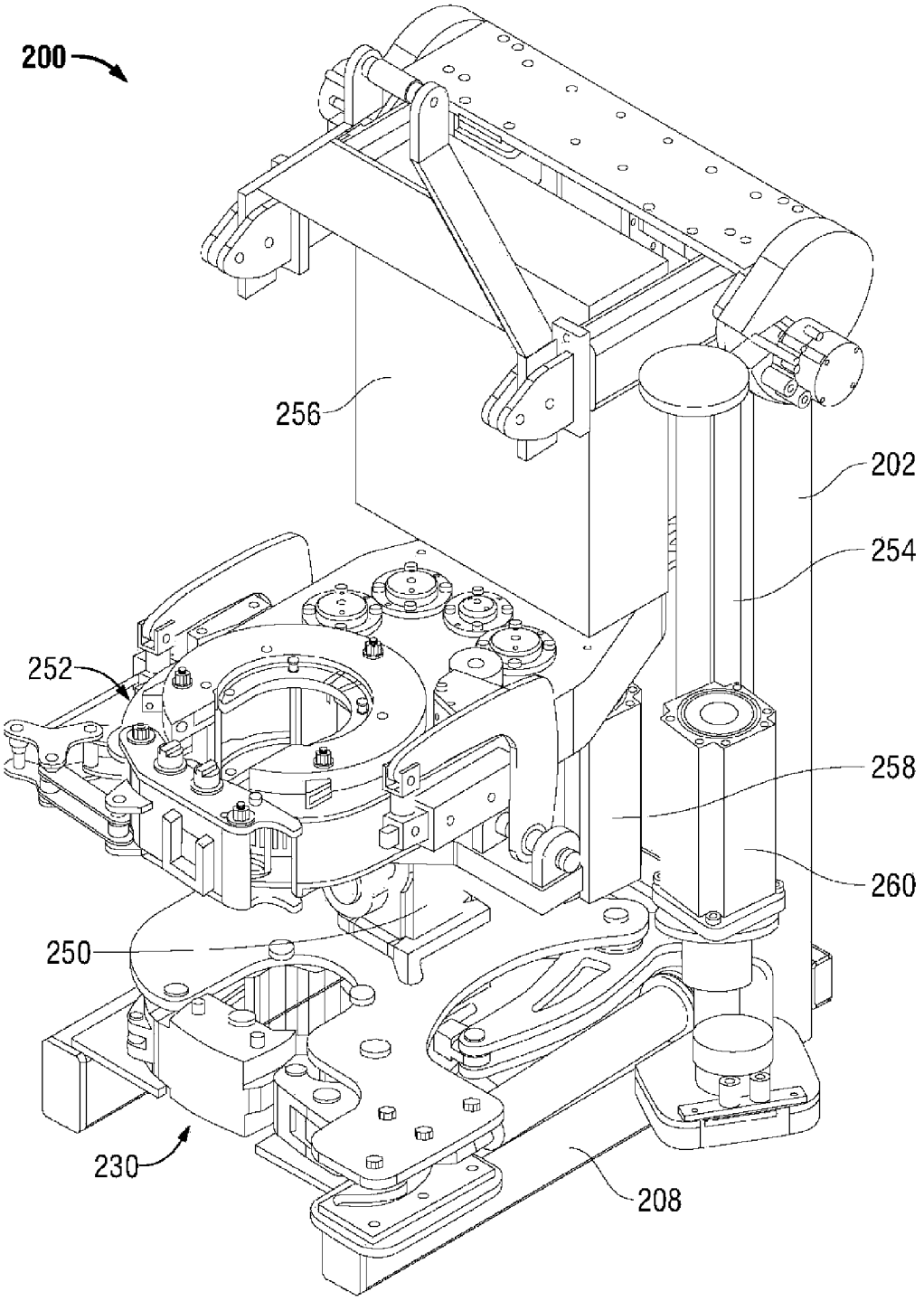
FIG. 11 is a perspective view of an electric tong system in accordance with one embodiment of the present invention.

In another embodiment, as shown in FIG. 11, the electric tong system (200) can comprise a backup tong (230) that is mounted to a post (250), similar to the backup tong disclosed in FIGS. 3-5. The electric tong system (200) can further comprise a power tong (252) that can be mounted to the post (250), above the backup tong (230), and a lower end of the post (250) can traverse a proximal end of the backup tong (230). Lower ends of the lift cylinders (254) may be connected to the base (208) of the frame (202), while the upper ends of the lift cylinders (254) can be connected to the frame (202) or upper U-shaped member, similar to the embodiment of FIG. 1. Electric motors (258) and (260) are shown for powering the power tong (252) and backup tong (230), respectively. The lift cylinders (254) are also powered by an electric motor, which is not shown in FIG. 11. An enclosure or box (256) may be mounted to the electric tong system (200) frame (202) to house a switchgear, wherein the box (256) can be used for protecting any onboard electrical equipment.

Figure 12:
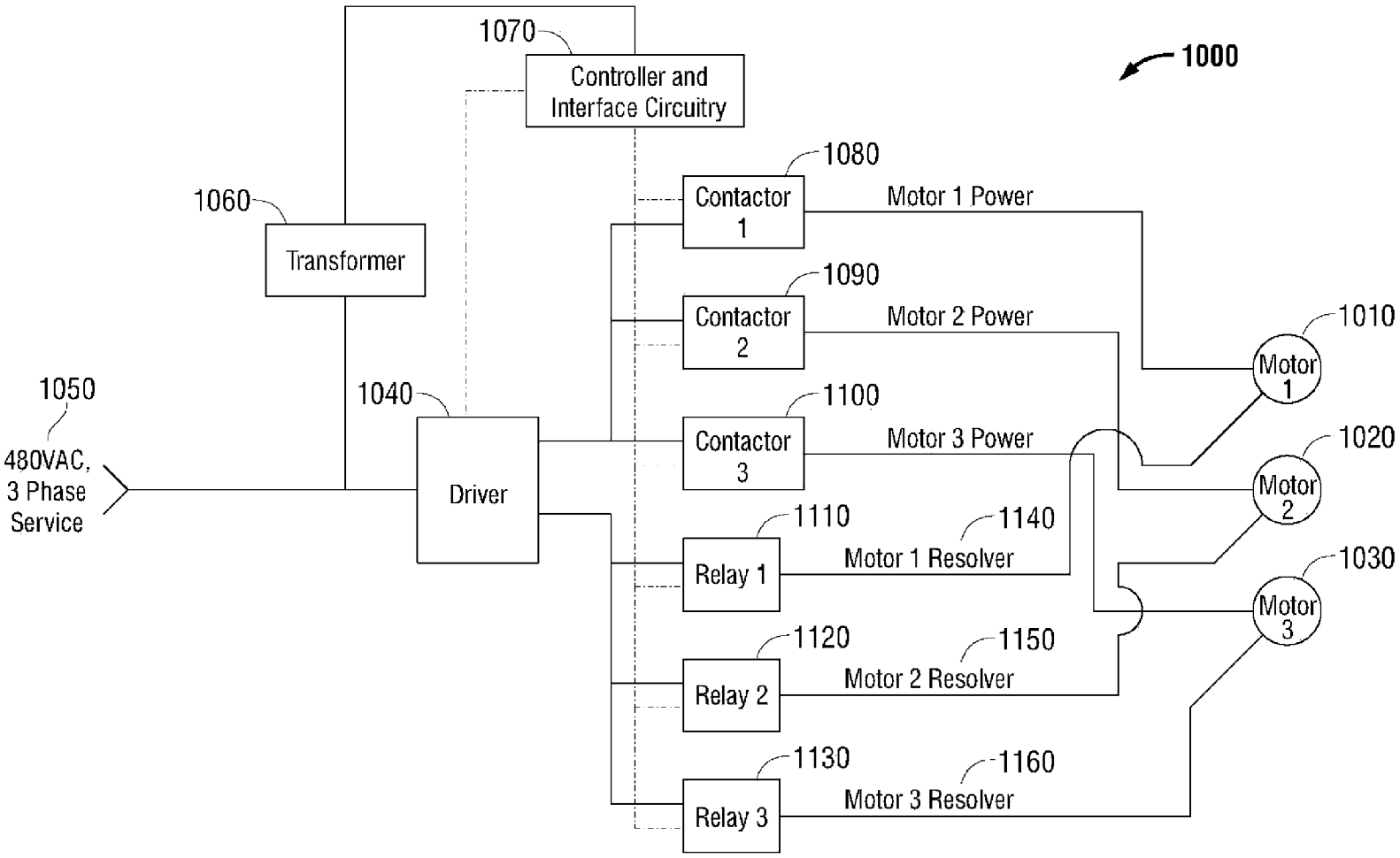
FIG. 12 is a schematic of a Motor Control Circuit in accordance with one embodiment of the present invention.

Referring to FIG. 12, an embodiment of a motor control circuit (MCC) (1000) is shown. The MCC (1000), in this embodiment, allows for control of "Motor 1" (1010), "Motor 2" (1020), and "Motor 3" (1030) with one driver (1040). Motors (1010, 1020, and 1030) interchangeably represent the electric motors that operate, for example, the power tong (50), backup tong (30), and lift cylinders (54*a*, 54*b*), as previously discussed in FIG. 1. The driver (1040) is shown connected to and powered by a 480 VAC, 3 phase electrical power source (1050). As shown, a controller and interface circuitry (1070) is powered by the power source (1050), also, with a transformer (1060) located therebetween. A plurality of contactors (1080), (1090), and (1100) and a plurality of relays (1110, 1120, and 1130), are connected between the driver (1040) and the motors (1010, 1020, 1030) for enabling the operation of the motors through the use of a single driver (1040). A plurality of resolvers (1140, 1150, and 1160) are depicted as connected between each relay (1110, 1120, and 1130) and corresponding motor (1010, 1020, and 1030). Based on programming and signals from sensors of the electric tong system, the controller (1070) can alternatively activate/close each contactor, via a signal line input, for closing a corresponding circuit, thereby connecting the driver (1040) to each motor to provide electrical power thereto. Similarly, the controller (1070) can alternatively activate/close each relay, via a signal line input, for closing a corresponding circuit, thereby connecting the driver to each resolver. Although FIG. 12 depicts a control circuit comprising three motors, other embodiments of the control circuit can contain any number of electrical motors and/or resolvers that require power from the driver.

In a conventional hydraulic backup tong, all backup tong functions are operated hydraulically by hydraulic cylinders that receive pressurized hydraulic fluid from a remote hydraulic power unit. The flow of hydraulic fluid into the cylinders is typically controlled by a pressure sequencing valve, which is connected between the directional control valve and the backup cylinders. This includes the control of the hydraulic actuation of the backup tong jaw grip, door opening, door closing, and door latching. Shifting the directional control valve lever will cause the backup tong grip cylinder to retract, thus releasing the grip, which is then closely followed by an opening of the backup latch and, then, the opening of the tong doors. Pushing the control valve lever will cause the backup doors to close, which is then closely followed by the closing of the backup latch and the extension of the gripping cylinder, causing the backup tong to grip the tubular. Upon release, the directional control valve spring returns to the central neutral position.

Regarding the present invention, the controlled sequence of functions, for operation of the backup tong (30), as previously discussed in FIG. 3-5, which can include the opening and closing of the backup door (76), the opening and closing of a jaw member (88), and the application, control, and release of the clamping force by a latching member, can be operated by two actuators. Specifically, the door can be opened and closed by a pneumatic backup door actuator or pneumatic cylinder (74), while the latching member can be actuated between locked and unlocked positions by a motor, for example, an electric motor ((82), as shown in FIGS. 6A and 6B), which is usable for back-up tong operations.

There are two conditions that dictate when a tubular joint is backed out of a wellbore. In the first instance, while running a tubular string, if the tubular joint is made up and the connection, via torque turn graph, is rejected, then the tubular joint will have to be disconnected. Because the tong was in "make-up mode", it will have to be switched to "break mode" to back out the joint. When the operator makes the switch to "break mode", the control system for the electric tong system sets the speed to "low gear" (low speed) for the power tongs. The second situation, where a tubular joint is backed out of a wellbore is during a 'pull' job (i.e., pulling all tubulars (e.g., casing, drill pipe, other tubulars) from the well bore). In this case, the electric tong system is in "break mode" throughout the job and is not switched from "make-up mode" to "break mode". Therefore, if the electric tong system is in "break mode" and the power tong door is opened and closed, then the power tong speed will be set to "low gear". Operationally, during a "pull job" the sequence is as follows:

1—Assume the electric tong system is in "break mode" and the backup tong and power tong doors are open.

2—The electric tong system is moved onto the pipe, and the electric tong system lift is adjusted so that the backup tong grips onto the connector and/or lower tubular joint, and the power tong grips onto the upper tubular joint to be removed.

3—The backup and power tong doors are closed, and the power tong is automatically switched into "low gear".

4—The power tong is rotated, and the tubular joint is backed out of the wellbore.

5—The rotary is aligned, and the power tong door is opened.

6—The backup tong is released, and the electric tong system is moved away from the well center.

7—The steps are repeated, from step 2 through step 6, as needed.

The electric tong system of the present application comprises an automated control system that enables automatic performance of the above steps, as set forth in the previous paragraph. In addition, the automation by the control system enables the electric tong system to be operated remotely, which provides an enhanced safety feature as the operator is no longer required to be located above or adjacent to the electric tong system (e.g., on scaffolding above the electric tong system). Conventional tongs typically do not have automatic sequences because they use a lever for each function (e.g., backup, lift cylinder, and tong rotary).

Figure 13A:
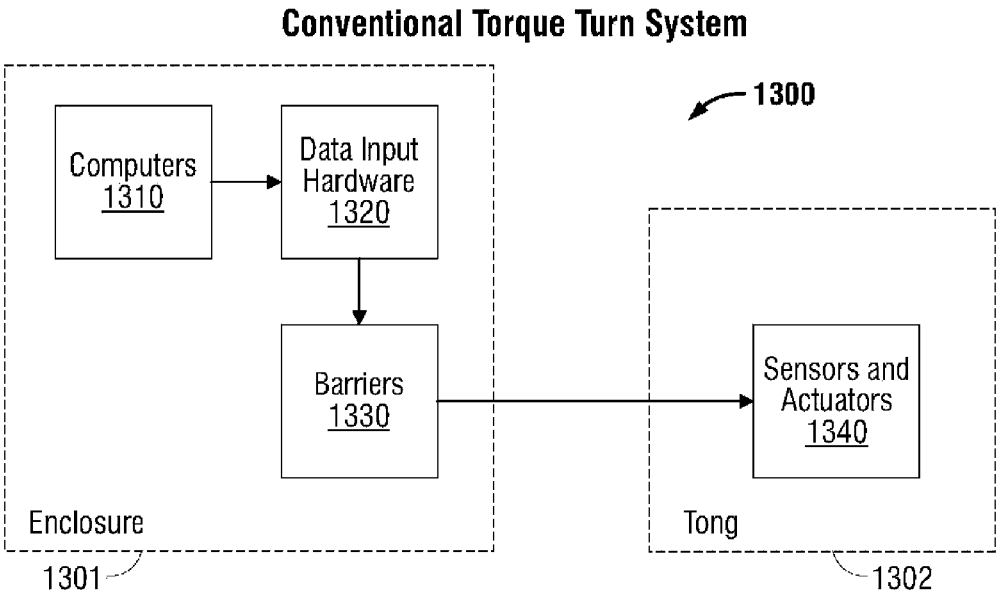
FIG. 13A is a schematic of a conventional torque turn system.

Referring to FIG. 13A, a conventional torque turn system (1300) is shown. The torque turn system (1300), such as Frank's® Data-Trek Advantage™, comprises hardware and software to record, graph, and display makeup data. The system (1300) comprises a computer (1310), data acquisition or in-put hardware (1320) (e.g., analog to digital converters, microcontrollers, etc.), intrinsically safe barriers (1330) (e.g., limits energy output into hazardous explosive areas), and sensors and actuators (1340). The computer (1310), data acquisition hardware (1320), and the barriers (1330) are installed in an enclosure (1301), while the sensors and actuators (1340) are installed on the power tong (1302).

Figure 13B:
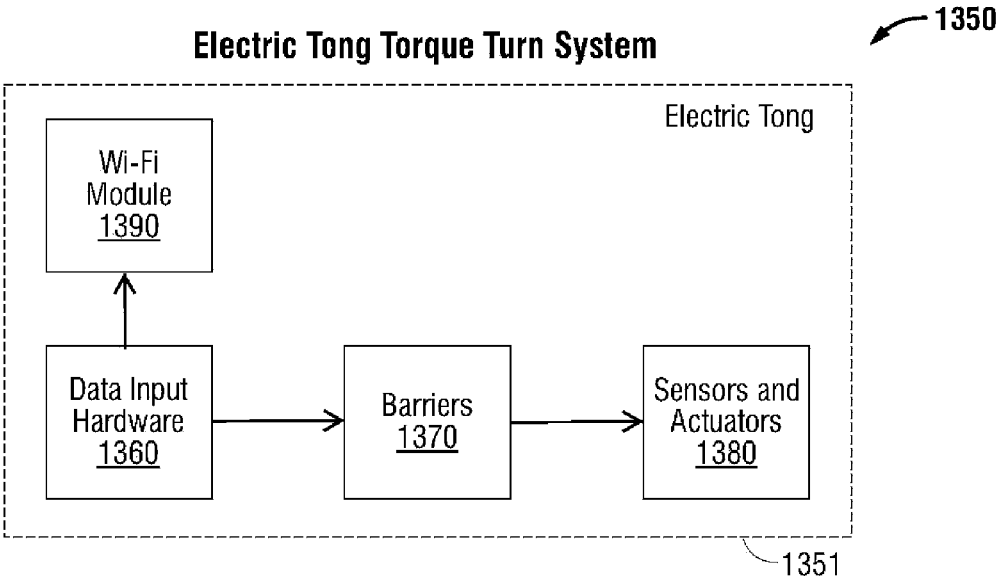
FIG. 13B is a schematic of a torque turn system for the tong system in accordance with one embodiment of the present invention.

Referring to FIG. 13B, the Figure shows an electric tong torque turn system (1350) that comprises the same components shown in the torque turn system (1300) of FIG. 13A, with the exception of the computer (1310) shown in FIG. 13A. The electric tong torque turn system (1350) comprises data acquisition hardware (1360) (analog to digital converters, microcontrollers, etc.), intrinsically safe barriers (1370) (limits energy output into hazardous explosive areas), sensors (1380), and WiFi capability (1390). The data acquisition hardware (1360), barriers (1370), sensors (1380), and WiFi (1390), can be located on the electric tong system (1351), itself. The electric tong torque turn system (1350) may further comprise a small alpha-numeric display for inputting torque and speed. The display can also display the numeric value of the torque as the connection is being made up. Analysis of the rotations or turns of the power tong, as well as the torque amounts, can be performed and used for determining, for example, proper make-up of a tubular joint.

Embodiments of the electric tong system can comprise a no side load reaction system, which can provide a solution to the destructive bending moment and shear forces created by a tong during make-up. The no side load reaction system is a "couple reactionary" device that eliminates the bending moment and shear forces in the connection. These forces, created by the application of torque, are cancelled at the centerline of the pipe, effectively applying only "pure torque" to the connection. Problems, such as alignment, are handled through the unique "floating support" design of the back-up. Small angular misalignment can be accommodated without any effect on the loads applied or the accuracy of the torque measurement. Torque is applied via a "couple" (e.g., a connection having two equal but opposite forces at a fixed distance). In a standard tong configuration, the forces are transmitted through a load cell and snub line, and the opposite force is transmitted through the connection to the pipe body. The resulting "side loads" are transmitted through the connection as a shear and bending moment. The externally induced loads cause high localized contact pressure between pin and box connections, which rely on high interference in either the threads or metallic seals. This additional contact pressure during make-up can greatly increase the incidence of galling. This system solves these problems through the application of innovative technology. The purpose of the no-side-load reaction system is to minimize the chances of galling of the threads and limit the forces that may increase friction during makeup.

Figure 14A:
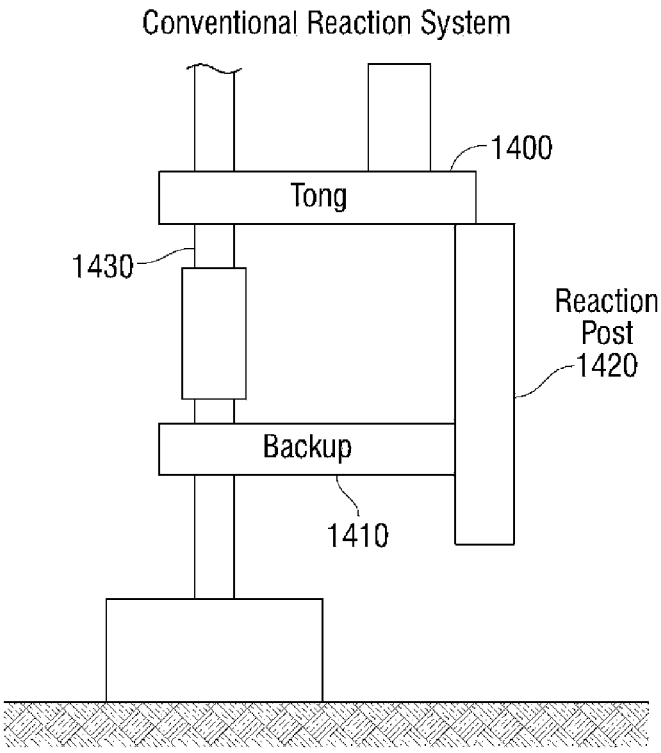
FIG. 14A is a side view schematic of a conventional reaction system.
Figure 14B:
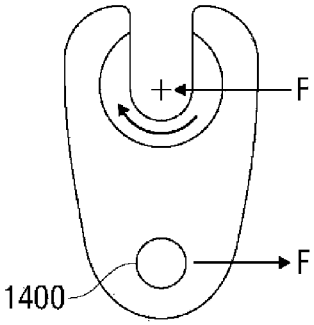
FIG. 14B is a schematic plan view of a power tong in the conventional reaction system of FIG. 14A.
Figure 14C:
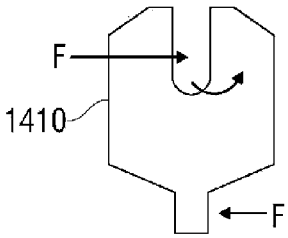
FIG. 14C is a schematic plan view of a backup tong in the conventional reaction system of FIG. 14A.
Figure 14D:
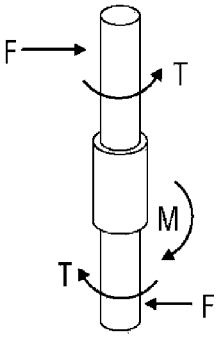
FIG. 14D is a schematic perspective view of a pipe string worked on by the conventional reaction system of FIG. 14A.

Referring to FIGS. 14A-14D, a schematic representation of a conventional reaction system, including a power tong (1400) and a backup tong (1410), is shown. The power tong (1400) and the backup tong (1410) are connected together by a reaction post (1420), and torque is applied by the power tong (1400) and reacted by the backup tong (1410), as shown in FIGS. 14B and 14C. A pipe (1430), which is shown in FIG. 14A as being connected or disconnected, has tong torque (T) and side forces (F) acting on it, as shown in FIGS. 14B and 14D. As further shown in FIG. 14D, the side force (F) creates a moment (M) on the pipe that comprises a magnitude equal to the side force (F) times the distance from the power tong (1400). A no-side-load reaction system functions to eliminate the side force (F) and moment (M).

Figure 15A:
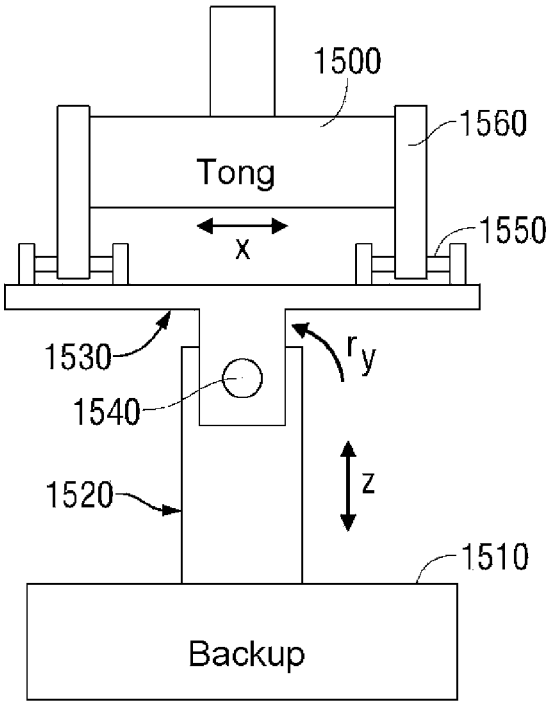
FIG. 15A is a back view schematic of a no side load reaction system for the tong system in accordance with one embodiment of the present invention.
Figure 15B:
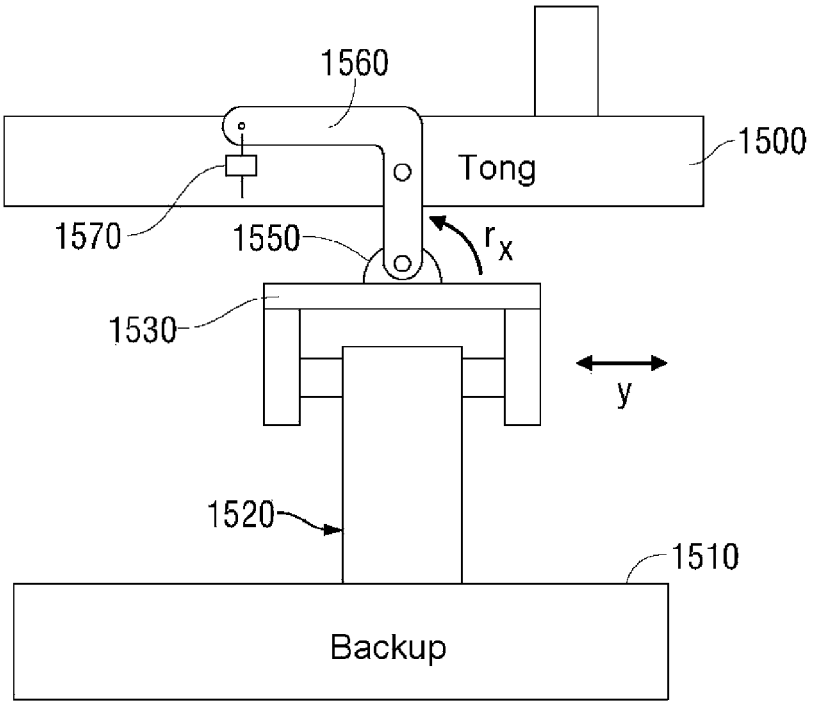
FIG. 15B is a side view schematic of the no side load reaction system for the tong system in FIG. 15A, in accordance with one embodiment of the present invention.
Figure 15C:
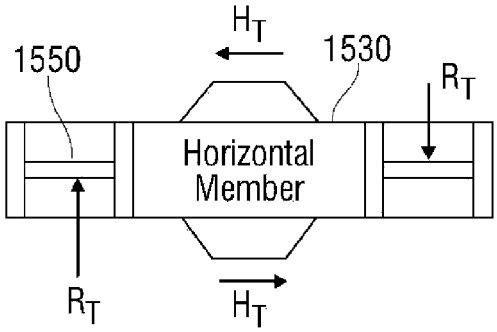
FIG. 15C is a plan view schematic of a horizontal member of the no side load reaction system for the tong system in FIG. 15A, in accordance with one embodiment of the present invention.
Figure 15D:
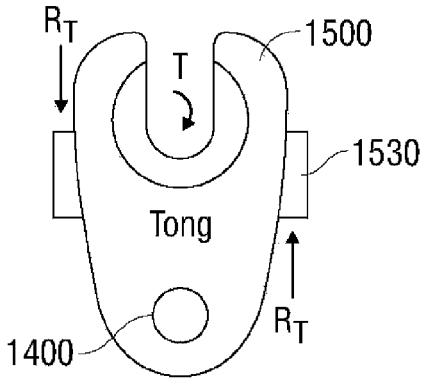
FIG. 15D is a plan view schematic of a tong of the no side load reaction system for the tong system in FIG. 15A, in accordance with one embodiment of the present invention.
Figure 15E:
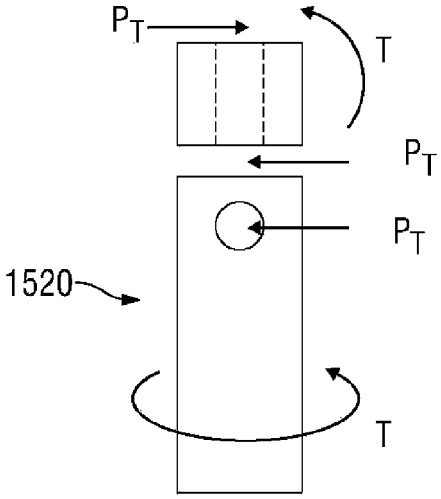
FIG. 15E is a side view schematic of the reaction post of the no side load reaction system for the tong system in FIG. 15A, in accordance with one embodiment of the present invention.

Referring to FIGS. 15A-15E, a schematic embodiment of an electric tong reaction system of the present invention is shown. A No-side Load Reaction System is described in U.S. Pat. Nos. 4,989,909 and 5,099,725, which are incorporated by reference herein in their entireties. In this embodiment, a power tong (1500) and a backup tong (1510) are connected to a reaction post (1520), and the power tong (1500) is mounted to a horizontal member (1530) that is pivotally connected to the reaction post (1520), near a top end by a shaft (1540) extending through the post (1520). As shown in FIGS. 15A-15C, mounting members (1550) of the horizontal member (1530) can provide for pivotal mounting of one end of a pair of "L" shaped members (1560), which are located on both sides of the tong (1500). In this embodiment, the other end of the "L" shaped members is pivotally connected to a side of the power tong (1500). The power tong diagram in FIG. 15D shows a torque (T) applied by the power tong (1500) which is transmitted to the horizontal member (1530) by a couple (Rt). A couple, such as Rt, is a force equal in magnitude and opposite in direction and separated by some distance. Because a couple is applied, there is no side load reacting on a pipe. FIG. 15E shows directional applications of torque (T) and linear force (Pt) applied to the reaction post (1520) of the no side load reaction system for the tong system (1500).

A good reaction system allows the power tong (1500) to translate a limited distance in the x, y, and z directions, and rotate about the x-axis and y-axis. In this embodiment, movement along the y-axis relates to the power tong (1500) moving forwards/backwards, movement along the x-axis relates to the power tong (1500) moving side to side, and movement along the z-axis relates to the power tong (1500) moving up/down. Further, rotation about x-axis is designated as $r_x$ as shown in FIG. 15B, and rotation about the y-axis is represented by $r_y$, as shown in FIG. 15A. To measure the torque (T) applied by the power tong (1500), a load cell (1570) can be connected to one end of the "L" shaped members (1560), as shown in FIG. 15B, wherein the load cell (1570) can be connected, also, to the side of the power tong (1500), such that upon the application of a torque (T), the load cell (1570) can be strained to produce an output.

The embodiments of the electric tong system previously discussed provide several advantages. As previously discussed, the tong system or electric tong consists of a power tong, backup tong, and lift cylinder that are integrated into one package and controlled and operated electrically, using one driver. The electric tong system can be built using a conventional hydraulic tong, for example, a 7⅝" casing tong, and replacing the hydraulic motor, gearbox, hydraulic valves and plumbing with an electric motor and gearbox, as previously discussed. The electric tong system, therefore, eliminates the need for the use of a hydraulic power unit, which prevents the environmental issues associated with leakage or spillage of hydraulic oil. In addition, the integrated electric tong system provides better torque control when making up or breaking out a tubular connection, and the system can be interlocked for safe operation. Additional advantages of the tong system include, the use of a Torque Turn system that is built into the electric tong system, (e.g., power tong), and which includes the capability for use with or without a computer for analyzing and recording torque and turn data that can be used for determining proper make-up or break-out of tubular connections. Other advantages of the tong system include: using a hand controller for remote operation to eliminate the requirement of operator stands, having remote monitoring/controlling via computer and WiFi, enabling easy rig up, eliminating separate RTS units, and providing a lower total system cost.

Additional features of the electric tong system, as previously discussed, include such features as: one driver to operate three motors (i.e., power tong motor, backup tong motor, and lift assembly motor). Typically, in conventional tong systems, each motor would require a separate driver. In addition, the electric tong system includes the use of servo-motors, which can enable better control of speed and direction of the tongs, and a single motor driver that controls the speed and direction of each servo-motor.

Further, the electric tong system utilizes an integrated design of the power tong, backup tong, and lift assembly. In conventional systems, the power tong and backup tong can be integrated; however, the lift cylinders are added when rigging up in the field. The embodiments of the present invention integrate the lift assembly with the power tong and backup tong into one package, which requires less rig-up time in the field. Additionally, torque turn is built into the control system.

Further, backing out a tubular joint in high gear (speed) presents a safety hazard, given that when the power tong is operated in the back out direction, the tong body can move towards the operator, potentially knocking the operator off of the scaffolding that he/she is standing on. Therefore, a safety feature of this tong is to automatically switch the power tong to low speed when backing out a tubular joint.

An additional feature of the electric tong system includes the use of an interlocking safety system, similar to the systems described in U.S. Pat. No. 5,791,410, and/or U.S. Pat. No. 7,891,418, incorporated herein in their entireties by reference. The interlocking system of the present invention enhances the safety of the operation of the electric tong system. For example, the lift motor is not allowed to move with the backup tong clamped on a tubular joint, the power tong is not allowed to rotate unless the backup tong is clamped on the tubular joint, and the power tong is not allowed to move unless the power tong door is closed. Although, the above pertains to interlocks between functions of the electric tong system, additional interlocking can take place between the electric tong system and other devices. For example, elevator slips may not be allowed to close unless the power tong has finished rotating.

Another feature of the electric tong system includes portability of the controls. Unlike conventional tongs, where the control valves are fixed to the tong, the electric tong system controls are portable. This portability feature allows the operator to be positioned for optimal viewing and safety during operation. For example, the tong stands (scaffolding) can be eliminated because the operator can control the tong from the floor and a safe distance.

Yet another feature of the electric tong system includes control configuration. The electric tong, unlike conventional tongs, can be configured to operate functions in a sequence. For example, with the push of a button, the tong door will close, the backup will latch, and the tong will rotate.

Yet another feature of the electric tong system includes the design of the backup. The backup uses a pneumatic cylinder to close the backup door and a linear actuator driven by an electrical motor, such as a servo motor, to apply the clamp force. In addition, the pneumatic backup door cylinder can comprise sensors, which can be used to detect when the clamping cylinder should actuate. The pneumatic backup door cylinder can further comprise a magnetic piston and two reed switches, wherein the reed switches are closed when the magnetic piston is moved near to them. When the backup door is closed, via the pneumatic cylinder, the reed switch, which is near the rod end of the pneumatic backup door cylinder, becomes activated and the electric motor, which actuates the linear actuator, becomes energized (the other reed switch alerts the backup control system when the backup door is open). The reed switches can also serve as position sensors on the pneumatic backup door cylinders. There is a position sensor, located on the rod end of the electric linear actuator, that can be used to determine an end-of-stroke condition, and the electric linear actuator can become de-energized during an end-of stroke condition.

Other features of the electric tong system include a no side load reaction system, which can have five (5) degrees of freedom, and an electrical lift system that can act like a conventional hydraulic lift cylinder or the RTS elevation function.

Another feature of the electric tong system includes a control system that allows manual or automatic operation of the electric tong system, with the flip of a switch. The electric tong system includes a built-in torque turn data acquisition system, which can be monitored by a WiFi computer. The WiFi computer allows monitoring, analysis, and control of the electric tong system on the drill floor or via satellite. An LCD screen can be included to read torque on the power tong, if torque turn is not required.

Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A tong assembly usable for threading and unthreading tubular members, wherein the tong assembly comprises:

a frame assembly comprising:

an upper frame;

a lower frame comprising a first vertical member and a second vertical member; and a first actuator connected to the upper frame and the lower frame, wherein the first actuator moves the upper frame with respect to the lower frame, and wherein the first actuator is driven only by a first electric motor;

a backup tong connected to the lower frame, wherein the backup tong comprises a central opening for receiving a lower tubular member, a backup tong door rotatably connected to the frame assembly, a latching arm rotatably connected to the frame assembly, and at least one second actuator connected to the frame assembly and the latching arm, wherein the at least one second actuator rotates the latching arm to close the backup tong door and progressively increase a force of contact between the backup tong door and the lower tubular member subsequent to closing the backup tong door, wherein the backup tong clamps and grips the lower tubular member, and wherein the backup tong is driven only by a second electric motor;

a power tong connected to the backup tong, wherein the power tong has a central opening for receiving an upper tubular member, wherein the power tong grips and rotates the upper tubular member, and wherein the power tong is driven only by a third electric motor; and a driver for controlling the first electric motor, the second electric motor and the third electric motor.

2. The tong assembly of claim 1, wherein the upper frame comprises a U-shaped member in telescoping engagement with the first vertical member and the second vertical member of the lower frame.

3. The tong assembly of claim 1, wherein the first electric motor is mounted to the upper frame and the second electric motor and the third electric motor are mounted to the lower frame.

4. The tong assembly of claim 1, further comprising a driver housing containing the driver and positioned remotely to the frame assembly.

5. The tong assembly of claim 4, wherein the frame assembly comprises a switchgear housing mounted to the frame assembly and operably connected to the driver housing.

6. The tong assembly of claim 4, wherein operable connections comprise a motor power cable, a motor resolver cable, a control cable, or combinations thereof.

7. The tong assembly of claim 1, wherein the power tong further comprises:

a housing comprising an opening;

a rotary mechanism located within the housing and comprising an opening, a plurality of jaws, and a ring gear operably connected to the third electric motor; and a power tong door rotatably connected to the housing and proximate to the opening of the housing, wherein the opening of the housing and the opening of the rotary mechanism align to comprise the central opening of the power tong.

8. The tong assembly of claim 7, wherein the power tong further comprises a plurality of sensors, wherein the plurality of sensors are monitored by a controller, wherein the controller sends a signal to actuate the plurality of jaws to secure the upper tubular member when the opening of the housing and the opening of the rotary mechanisms are aligned and the power tong door is closed.

9. The tong assembly of claim 7, wherein the ring gear and rotary mechanism transfer torque from the third electric motor to the upper tubular member when the plurality of jaws are actuated.

10. The tong assembly of claim 1, wherein the frame assembly further comprises a base, wherein the base comprises a plurality of rail guide members for engagement with a plurality of rails.

11. The tong assembly of claim 1, wherein the first actuator and the at least one second actuator are linear actuators.

12. The tong assembly of claim 1, wherein the first actuator, the at least one second actuator, the power tong, the backup tong, and the driver are each operably connected to a Wi-Fi module, a wireless transmitter, a radio transceiver, or combinations thereof, for transmitting data to or from a remote computer.

13. A backup tong usable for clamping and gripping a tubular member during threading and unthreading of the tubular member, wherein the backup tong comprises:

a frame partially defining a central opening, wherein the central opening receives a tubular member;

a door rotatably connected to the frame, wherein the door is rotatable between an open position and a closed position, wherein the door partially defines the central opening;

a latching arm rotatably connected to the frame, wherein the latching arm latches the door in a closed position;

a first linear actuator connected to the frame and to the door, wherein the first linear actuator rotates the door between the open position and the closed position;

a second linear actuator connected to the frame and to the latching arm, wherein the second linear actuator rotates the latching arm to latch the door in a closed position, and wherein the rotation of the latching arm progressively increases a force of contact between the door and the tubular member a load cell located within the frame;

a load transfer member comprising a first end and a second end, wherein the first end is connected to the load cell, wherein the second end is connected to the second linear actuator, wherein the load transfer member is pivotably connected to the frame, and wherein the load transfer member transfers a proportion of force received from the second linear actuator to a capacity of the load cell; and an electric motor that drives the second linear actuator.

14. The backup tong of claim 13, further comprising a first sensor operably connected to the first linear actuator, wherein the first sensor detects the position of the first linear actuator.

15. The backup tong of claim 14, wherein the first sensor signals for the deactivation of the first linear actuator when the first linear actuator is in an end-of-stroke condition.

16. The backup tong of claim 15, wherein the first sensor signals for the activation of the second linear actuator when the first linear actuator is in an end-of-stroke condition.

17. The backup tong of claim 14, further comprising a second sensor operably connected to the second linear actuator, wherein the second sensor detects the position of the second linear actuator.

18. The backup tong of claim 13, wherein the load transfer member is J-shaped.

19. The backup tong of claim 13, wherein the frame further comprises at least one guide plate, and wherein the second linear actuator comprises at least one protrusion intersecting with the at least one guide plate of the frame.

20. The backup tong of claim 13, wherein the central opening is further defined by at least one gripping member for gripping a tubular.

21. The backup tong of claim 13, further comprising a locking mechanism on the frame for locking the frame into place and preventing undesired adjustments.

22. A method of using a tong assembly for installing or removing a plurality of tubulars into or from a wellbore, the method comprising:

(a) positioning an electric tong system onto a joint of tubulars comprising an upper tubular connected to a lower tubular with a connector, wherein the electric tong system comprises a frame assembly, a backup tong comprising a first opening, a first door, and a latching arm, and a power tong comprising a second opening, a second door, and a plurality of jaws;

(b) adjusting the frame assembly using a first linear actuator driven by a first electric motor for positioning the power tong and the backup tong with respect to the connector;

(c) aligning the first opening of the backup tong with the second opening of the power tong, wherein the aligned backup tong is driven by a second electric motor and grips the lower tubular, wherein the aligned power tong is driven by a third electric motor and grips the upper tubular, and wherein the first electric motor, second electric motor, and third electric motor are controlled by a driver;

(d) closing the first door and the second door, wherein the first door triggers at least one second linear actuator to compress the first door against the connector, and wherein the second door triggers the plurality of jaws to compress the upper tubular against a rotary mechanism and operably connects the rotary mechanism to an electric motor while in a low gear;

(e) locking the frame assembly in place and preventing adjustments thereto until the closed first door has been re-opened in step (h);

(f) rotating the aligned power tong until the upper tubular is connected or disconnected from the lower tubular;

(g) aligning the rotary mechanism with the second opening for opening the second door;

(h) de-energizing the at least one second linear actuator to open the first door; and (i) installing or removing the upper tubular into or from the wellbore, respectively.

23. The method of claim 22, further comprising repeating steps (b) through (i).

24. The method of claim 22, wherein the step of closing the first door further comprises actuating the at least one second linear actuator connected to the frame assembly and to the latching arm for rotating the latching arm to latch the first door in a closed position, wherein the rotating of the latching arm progressively increases a force of contact between the first door and the lower tubular.

25. The method of claim 22, wherein step (f) cannot occur until the first door has been closed.

26. The method of claim 22, wherein the electric tong system may only do one of the following steps at a time: adjusting the frame assembly, compressing the first door, and rotating the power tong.

27. The method of claim 22, wherein the frame assembly further comprises a load cell located within the frame assembly and a load transfer member pivotably connected to the frame assembly, wherein the load transfer member comprises a first end connected to the load cell and a second end connected to the at least one second linear actuator, and wherein the load transfer member transfers a proportion of force received from the at least one second linear actuator to the load cell.

* * * * *